US007611999B2

(12) United States Patent
McMurray

(10) Patent No.: US 7,611,999 B2
(45) Date of Patent: Nov. 3, 2009

(54) DECORATIVE FACED MULTI-LAYER WEFT KNIT SPACER FABRIC, METHOD, AND ARTICLES MADE THEREFROM

(76) Inventor: Brian McMurray, 105 Vann Pl., Aberdeen, NC (US) 28315

( * ) Notice: Subject to any disclaimer, the term of this patent is extended or adjusted under 35 U.S.C. 154(b) by 127 days.

(21) Appl. No.: 10/704,044

(22) Filed: Nov. 7, 2003

(65) Prior Publication Data

US 2004/0097151 A1 May 20, 2004

Related U.S. Application Data

(60) Provisional application No. 60/426,748, filed on Nov. 16, 2002, provisional application No. 60/429,622, filed on Nov. 27, 2002.

(51) Int. Cl.

| | |
|---|---|
| ***D04B 1/00*** | (2006.01) |
| ***D04B 1/18*** | (2006.01) |
| ***D04B 1/14*** | (2006.01) |
| ***D04B 9/06*** | (2006.01) |
| ***D04B 9/34*** | (2006.01) |
| ***D04B 1/22*** | (2006.01) |
| ***D04B 1/26*** | (2006.01) |
| ***D04B 7/04*** | (2006.01) |

(52) U.S. Cl. ..... 442/304; 442/306; 442/308; 442/312; 66/19; 66/136; 66/170; 66/172; 66/196

(58) Field of Classification Search ..... 442/304, 442/306, 308, 312; 66/18, 136, 170, 172, 66/196

See application file for complete search history.

(56) References Cited

U.S. PATENT DOCUMENTS

| | | | | |
|---|---|---|---|---|
| 5,284,031 | A | 2/1994 | Stoll | |
| 5,385,036 | A * | 1/1995 | Spillane et al. | 66/87 |
| 5,395,684 | A | 3/1995 | Robinson | |
| 5,422,153 | A | 6/1995 | Miyamoto | |
| 5,651,847 | A * | 7/1997 | Loeffler | 66/19 |
| 5,687,587 | A * | 11/1997 | Michel | 66/196 |
| 5,735,145 | A * | 4/1998 | Pernick | 66/196 |
| 6,263,707 | B1 * | 7/2001 | Miller et al. | 66/171 |
| 6,287,168 | B1 * | 9/2001 | Rabinowicz | 450/75 |
| 6,627,562 | B1 * | 9/2003 | Gehring, Jr. | 442/35 |
| 6,779,369 | B2 * | 8/2004 | Shepherd | 66/196 |
| 6,824,445 | B2 * | 11/2004 | Oneyear et al. | 450/70 |
| 2001/0007929 | A1 * | 7/2001 | Schlomski | 602/63 |

FOREIGN PATENT DOCUMENTS

EP 1348788 A1 * 1/2003

* cited by examiner

*Primary Examiner*—Elizabeth M Cole
*Assistant Examiner*—Jennifer Steele
(74) *Attorney, Agent, or Firm*—Kilpatrick Stockton LLP

(57) ABSTRACT

A breathable, stretchable, and heat-moldable multi-layer weft knit spacer fabric having a substantially decorative first layer and a spaced less decorative second layer. Also, a method of integrally knitting the multi-layer knitted fabric on a circular weft knit machine is also described. Articles of the manufacture comprising the fabric are also described.

22 Claims, 18 Drawing Sheets

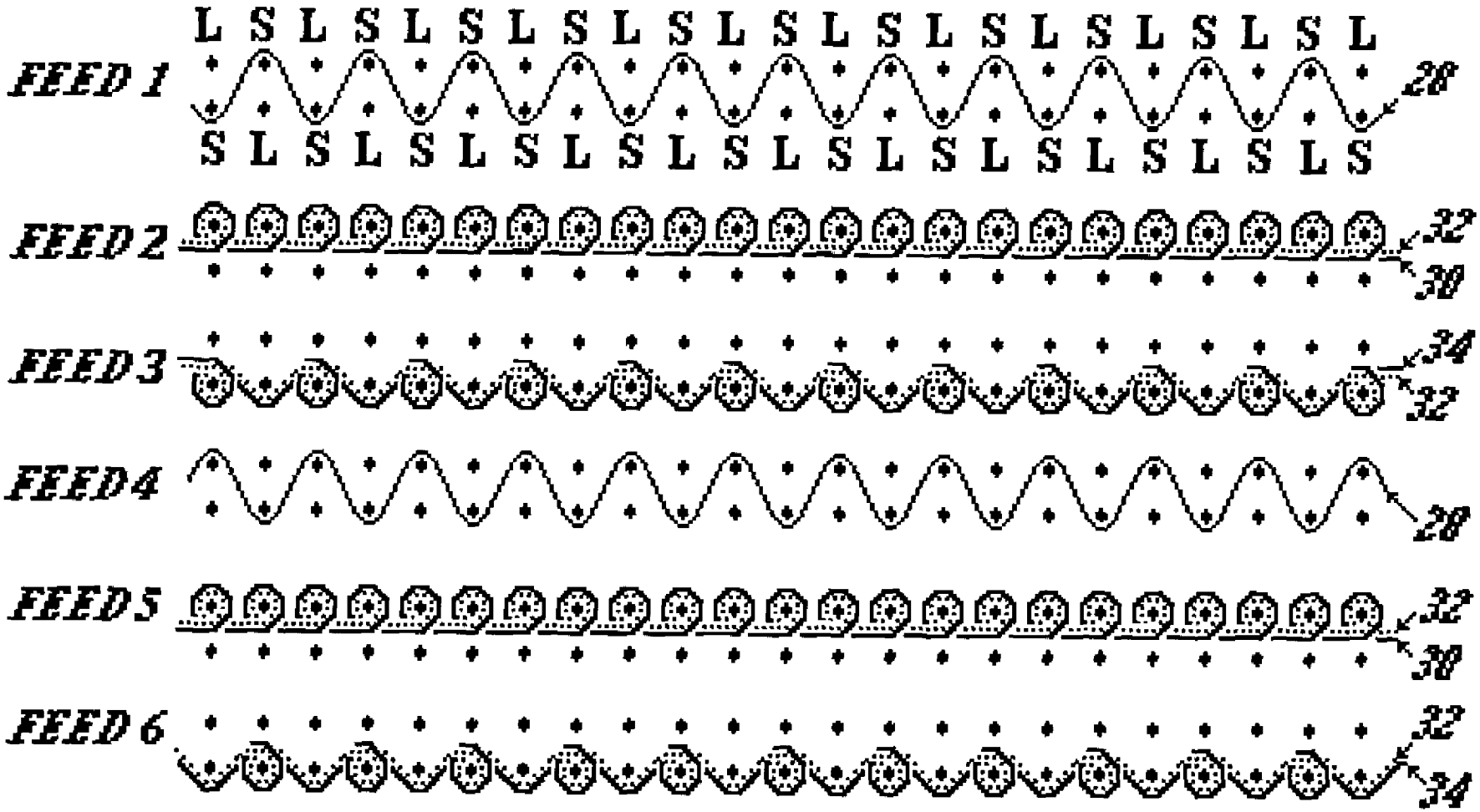
FEED 1
L S L S L S

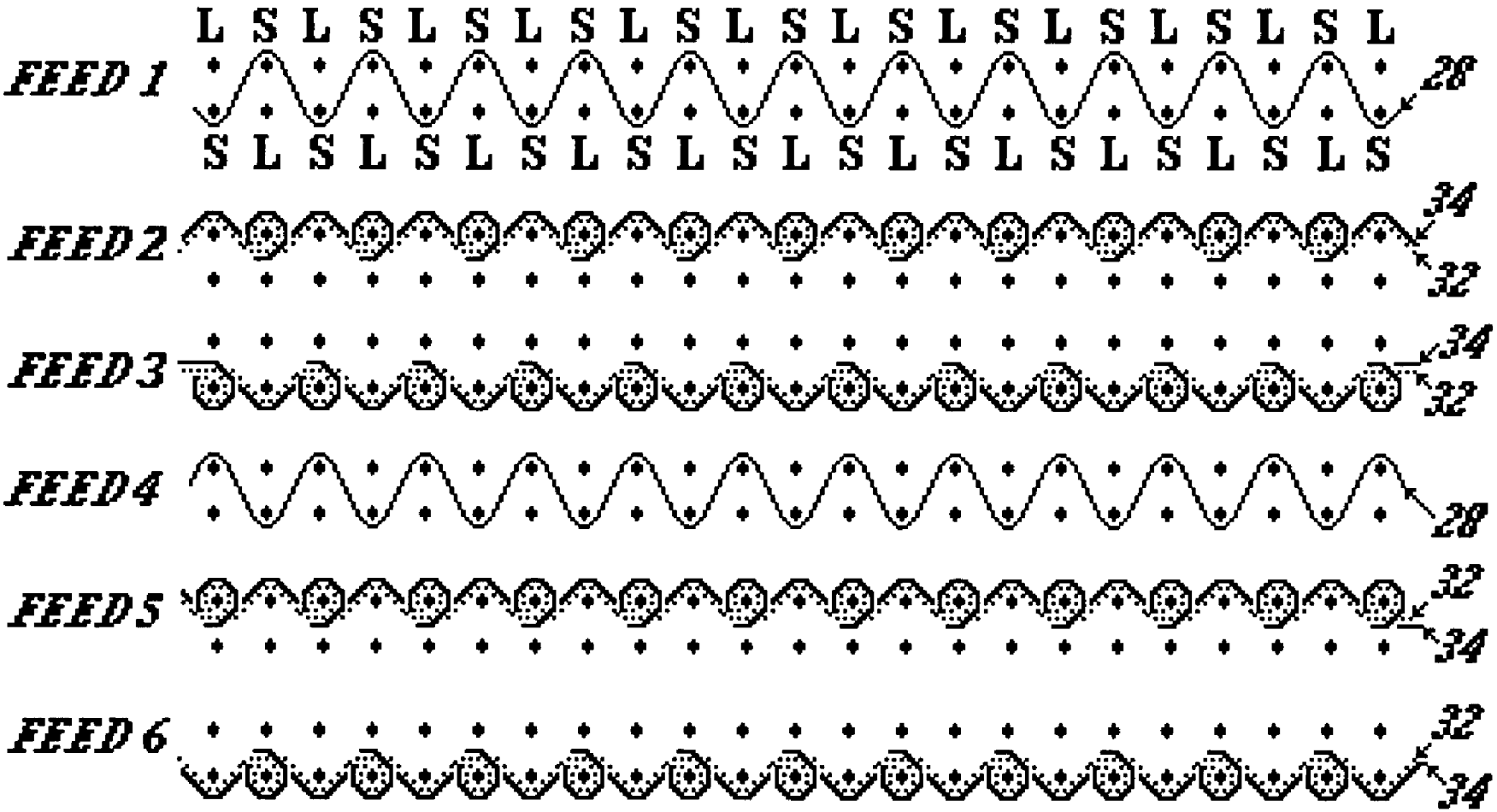
FEED 1
L S L S L S

DECORATIVE FACED MULTI-LAYER WEFT KNIT SPACER FABRIC, METHOD, AND ARTICLES MADE THEREFROM

CROSS-REFERENCE TO RELATED APPLICATIONS

This non-provisional utility patent application claims the benefit of one or more prior filed co-pending applications; a reference to each such prior application is identified as the relationship of the applications and application number (series code/serial number) as follows: the present application is filed as a non-provisional and claims the priority filing date and benefit based upon the following provisional patent applications: Ser. No. 60/426,748 filed Nov. 16, 2002 and Ser. No. 60/429,622 filed Nov. 27, 2002, which are incorporated herein by reference in their entirety.

FIELD OF THE INVENTION

The present invention generally relates to a highly lustrous satin faced multi-layer weft knit spacer fabric with advantageous performance properties. Embodiments of the fabric are stretchable, breathable, and/or heat-moldable. The present invention also relates to articles of manufacture, e.g. clothes, produced from the fabric. Also disclosed is a method for making a multi-layer weft knit spacer fabric,

BACKGROUND

In the production of garments such as brassieres, foundation, and medical support garments it is often necessary to provide specific reinforcement in specific areas of the garment in order to enable the garment to provide a desired support function and comfort to the wearer. Typically the reinforcement is provided by incorporating into such garments separate reinforcement members, e.g. additional differing or similar fabric layers, padding, wires, or shaped foam parts. The use of shaped urethane or similar foam as padding, while accomplishing a desired shape and reinforcement function, can be uncomfortable to the garment wearer in that it impedes air flow and limits or prevents breath ability and moisture escape and can be construed as hot or uncomfortable to the wearer. The provision of separate reinforcement members can also be highly undesirable, as they require a garment to be specially modified according to the vast individual sizes required to accommodate the wearers. This increases the cost of the production of the garment by exponentially increasing the number of different size reinforcement members one must stock, as well as the added number of fabric cutting and sewing steps required. For example, using these existing methods for making an aesthetically attractive high luster satin fabric padded brassiere breast cup with a foam or fiberfill pad support it would be necessary to use a first distinct and separate satin fabric outer face, using either a stretch woven true satin construction or an elastomeric warp knitted Raschel or Tricot satin fabric in addition a second or middle layer, or multiple layers of fiberfill padding, or a shaped foam part, and a third substrate fabric layer for the inside lining of the brassiere cup, all to be precisely cut and sewn together according to a size specific garment requirement. Traditional satin construction fabrics are well known in the trade and historically had their early beginnings in weaving, whereby a high luster smooth face surface is accomplished through the satin class of weaves by floating individual warp or weft yarns of preferably bright luster for a higher number of picks or ends in the weave repeat before interlacing and binding the floats down.

Woven satin constructions are typically produced using a minimum of 5 harnesses, and up to 8 harnesses or more, in which case the individual yarn floats are from 4 to 7 ends or picks in length. The woven satin effect is further enhanced by weaving a very high number of ends/picks per inch texture quality in order to produce a smooth, relatively plain looking fabric surface that comprise a satin. A Raschel warp knit satin can be accomplished similarly to the woven approach by utilizing a knit construction that provides long floats on the technical back surface that are crowded together in a dense high courses per inch texture that can further be increased by introducing an elastomeric yarn such as spandex that further compacts and crowds the bright yarn floats into a high density, yielding the best quality satin effect. In the case of weft knitting, and more specifically the technical face side of a single knit fabric construction which is required in the present invention whereby a multi layered spacer fabric composite construction is utilized and therefore has both external fabric surface sides exposing the technical face, there is no possibility to float a bright luster yarn on the surface as can be accomplished on the technical back side. Therefore, a unique knitting method is required to maximize the length of the individual legs of the technical face knitted stitch in such a way as to produce a satin surface result.

Integrally formed multiple layer fabrics are known and have been illustrated, for example, by U.S. Pat. Nos. 5,735,145, 5,284,031, 5,422,153, 5,395,684, to Pernick, Stoll et al., Miyamoto, and Robinson et al. respectively The patent to Pernick describes an incontinence mattress pad product made of a multiple layer weft knit fabric specifically for absorbing moisture and wicking it from a first hydrophobic layer to a second hydrophilic layer by using spacer yarns of a preferably non-textured continuous multifilament Polyester. The patent to Stoll et al. describes a multiple layer knitted structure which can be produced on a two-bed, flat bar knitting machine, and which is to include stable fabric webs connecting first and second parallel fabric webs. The patent to Miyamoto describes a weft knit composite fabric for decorating the interior and exterior of buildings, cars, furniture, bags, or the like. The fabric has first and second knitted layers that are tied together by alternating courses of S- and Z-twist yarns. The patent to Robinson et al. describes a double-faced, knitted, glass-fiber fabric, in which the faces are interconnected by at least one linking thread that passes from one face to the other. The linking thread is described as preferably being made of glass fiber. There are no references in any of the aforementioned patents as to the incorporation of a substantially high luster satin knit structure on any of the fabric layers in a multi-layer, weft-knitted, spacer construction. There also are no references to a stretchable, heat-moldable spacer fabric for use in intimate apparel or medical garments.

A general aim of the present invention is to provide a method of producing a single stretchable and moldable spacer fabric substrate that is at once a pleasing high luster satin effect integrally knitted into the outer face fabric surface, a resilient, stretchable, middle-spacer-yarn connecting layer, and an inner fabric lining layer that may be plain, textured or fancy, all formed as one single and homogenous unified structure during the knitting process.

SUMMARY OF THE INVENTION

The present invention provides embodiments of decoratively-enhanced fabrics with advantageous performance properties. The present invention also provides methods for producing fabrics.

In an aspect the present invention comprises an integrally formed weft knit fabric structure having first and second knit fabric layers that are secured in a parallel and spaced relationship with each other by a plurality of resilient spacer yarns that extend between the first and second layers.

More specifically an embodiment of the present invention provides a multi-layer weft knit fabric having first and second parallel knit fabric layers, at least one of said first or second layers having a printed decorative design using any one or more patterns selected from a group consisting of geometric, free-form, floral, abstract, brand logos, or the like on the outer technical face surface of said layer, and the other layer having either a decorative design effect on the outer technical face surface, or if preferred, a less decorative construction, said layers being joined together by a series of knit or laid-in courses forming spacer yarns which secure the first and second fabric layers together in a spaced relationship to each other. The printed design may be applied to one or more fabric face surfaces using any standard state of the art open width fabric printing method such as heat transfer printing or, most preferably, a rotary screen printing process of at least one or more screen colors that are applied to the surface of the fabric which has been properly prepared for such print process, and the surface of the discrete fabric layer receiving the print design may be an overall plain surface such as the decorative satin construction surface according to the present invention or may be any fabric surface formed using any combination of stitches including knit, miss, and/or tuck stitches. Similarly, a less decorative construction may be formed using a combination of stitches including knit, miss, and/or tuck stitches. In the instance of a satin face construction, it may be comprised of a bright high luster yarn which when knitted into the satin stitch will yield a highly lustrous and bright, reflective fabric surface that may be printed with a highly contrasting and complimentary dull or delustered pigment print design of at least one color.

Any of the conventional yarn types known in the art may be utilized to produce a weft knit fabric of the present invention, including, but not limited to natural and synthetic yarns produced from spandex, nylon, polyester, cotton and/or blends thereof. The spacer courses may comprise similar yarns. In a preferred embodiment of the present invention the spacer courses comprise a substantially resilient and thermo-settable continuous-filament synthetic yarn. The synthetic yarn may comprise a textured multifilament yarn or a flat non-textured multifilament yarn wherein the synthetic yarn comprises polyester or nylon.

In all of the described embodiments of the present invention it is emphasized that the synthetic continuous-filament yarn components of spandex, nylon, and polyester used in the first and second discrete fabric layers, as well as the spacer yarn are chosen and required in the present invention for their unique thermal heat setting properties which provide the ability to heat-mold the spacer product to desired form and shape, as in the case of the provided exemplary illustration of a brassiere garment molded breast cup embodiment while imparting a permanent heat memory property to the spacer fabric product permitting the molding process to shape the fabric and still maintain all functions of stretch, thickness, and comfort breath ability.

A feature of the present invention is that an embodiment of the present invention provides an economic, decorative-faced, embossed-design, multi-layer, weft-knit, spacer fabric that has first and second knit parallel layers integrally knitted and joined together by a series of knit courses forming spacer yarns which discretely secure the first and second layers together in a spaced relationship to each other.

Another feature of the present invention is that an embodiment of the present invention provides a weft-knitted, multi-layer, spacer fabric that has at least one of said first or second layers having an embossed printed decorative design formed using the method of heat-embossing the surface of the fabric using one of the machine configurations available in the trade such as a heated metal male engraved roll bearing the pattern design to be applied with heat and pressure against either a smooth back roll or a synchronized roll that has the identical design engraved negatively into a female back roll comprised of metal, husk, or one of the suitable materials used in embossing technology. In this application of pattern design, it is also envisioned that a combination of embossing with a heated engraved roll and an added component of colored heat transfer paper between the heated roll and the subject multi-layered spacer weft knit fabric surface will at once apply an embossed pattern design comprising both dimension and color to an otherwise plain fabric surface.

Yet another feature of the present invention is that an embodiment of the present invention provides a weft-knitted, multi-layer, spacer fabric that has at least one of said first or second layers having a design applied to the surface by means of laser engraving, which sculptures the design into the technical face fibers of the desired face fabric layer. Laser design engraving of fabric containing either natural or synthetic fibers, or a combination of both on the surface, are proven and continually explored techniques of adding decoration to an otherwise plain fabric surface.

A further feature of the present invention is that an embodiment of the present invention provides a weft-knitted, multi-layer, spacer fabric having either or both of the first and second fabric layers integrally knitted with specialty bi-component or multi-component yarn containing a desired blend level of at least two distinct fibers with different coloration possibilities within the yarn itself being achieved either by piece dyeing the knitted fabric containing said yarn using at least one dyestuff with different fiber affinity properties such as acid dyes, disperse dyes, cationic dyes, reactive dyes, or direct dyes to color at least one fiber type within the yarn bundle thereby forming a heather of marled effect fabric face with the yarn using one or a combination of stitches including knit, miss, or tuck stitches, on the outer technical face surface of either or both the first and second fabric layers.

A still further feature of the present invention is that an embodiment of the present invention provides a decorative, heather-effect-faced, weft-knitted, multi-layer, spacer fabric that utilizes a combination specialty spun yarn that may contain either pre-dyed fibers such as cotton that have the pre-dyed multi-colored heather effect in the yarn itself, or, may be a combination of natural and synthetic yarn blends such as natural cotton with solution dyed polyester whereby the yarn in fabric form may be over-dyed during a piece dyeing process, or may be a combination blended spun yarn whereby a portion of the fibers have been treated to alter their dye type affinity prior to the spinning process such as a blended spun or plied cotton fiber yarn having both reactive dye and direct dye affinities.

An additional feature of the present invention is that embodiments of the present invention provide in one single homogenous composite a spacer fabric consisting of two parallel fabric layers integrally knitted and joined together by resilient continuous-filament synthetic yarns in a defined spaced relationship that has at least one fabric surface layer with either a decorative Jacquard design, Satin surface, Printed surface, Embossed surface, Embossed Printed Surface, or Specialty Yarn Heather effect design on the technical face surface of at least one fabric layer and provides a multilayer fabric substrate that may include spandex elastomeric yarn that is at once stretchable, breathable, and heat-moldable, while still maintaining a spaced relationship of the two fabric layers.

Embodiments of the fabric of the present invention may be advantageously utilized in articles of manufacture. Accordingly, a further aspect of the present invention is an article of manufacture comprising a fabric of the present invention Embodiments of the present invention provide methods of making engineered, decoratively-faced, weft-knitted, multilayered, spacer fabrics that may be Jacquard knitted face, Satin face, Printed face, Embossed face, Embossed Printed or Specialty Yarn faced fabric consisting of a first fabric layer, a second fabric layer, and a connecting middle spacer structure layer that facilitate the manufacturing of finished supportive intimate apparel, foundation, fashion swimwear, performance swimwear, active performance or fitness wear, and medical garments in a minimal number of manufacturing steps.

In a preferred form of the invention, the space between the first and second discrete fabric layers is between about $1/16^{th}$ and $3/16^{ths}$ of an inch.

In a preferred form of the invention, the fabric is knit on a circular weft knitting machine containing two distinct needle systems of both cylinder and dial needle beds. In this embodiment of the invention, the first discrete fabric layer is formed with a satin stitch pattern on the technical face outer surface and is knit on the cylinder needles and utilizes needle selection controls to construct the decorative design, such as jacquard or satin design, during the formation of the spacer fabric, the second less decorative discrete fabric layer is knit on the dial needles, and the spacer yarns are alternately either knit or laid into the stitches of the first and second discrete fabric layers in an alternating fashion so as to place the spacer yarns in a traverse pattern back and forth between the two layers. In a particularly preferred embodiment of the present invention, an interlock directly opposed needle gating is used for the two needle beds, that is, the needles on the two beds are exactly opposite to each other, and in a less preferred embodiment cylinder and dial needles are offset from one another into a standard conventional rib gating.

BRIEF DESCRIPTION OF THE DRAWINGS

FIG. 13*a* shows a weft-knitting sequence used in forming a fabric according to a preferred embodiment of the present invention.

FIG. 13*b* shows an alternate preferred weft knitting sequence according to an embodiment of the present invention.

DETAILED DESCRIPTION

Figure 1:
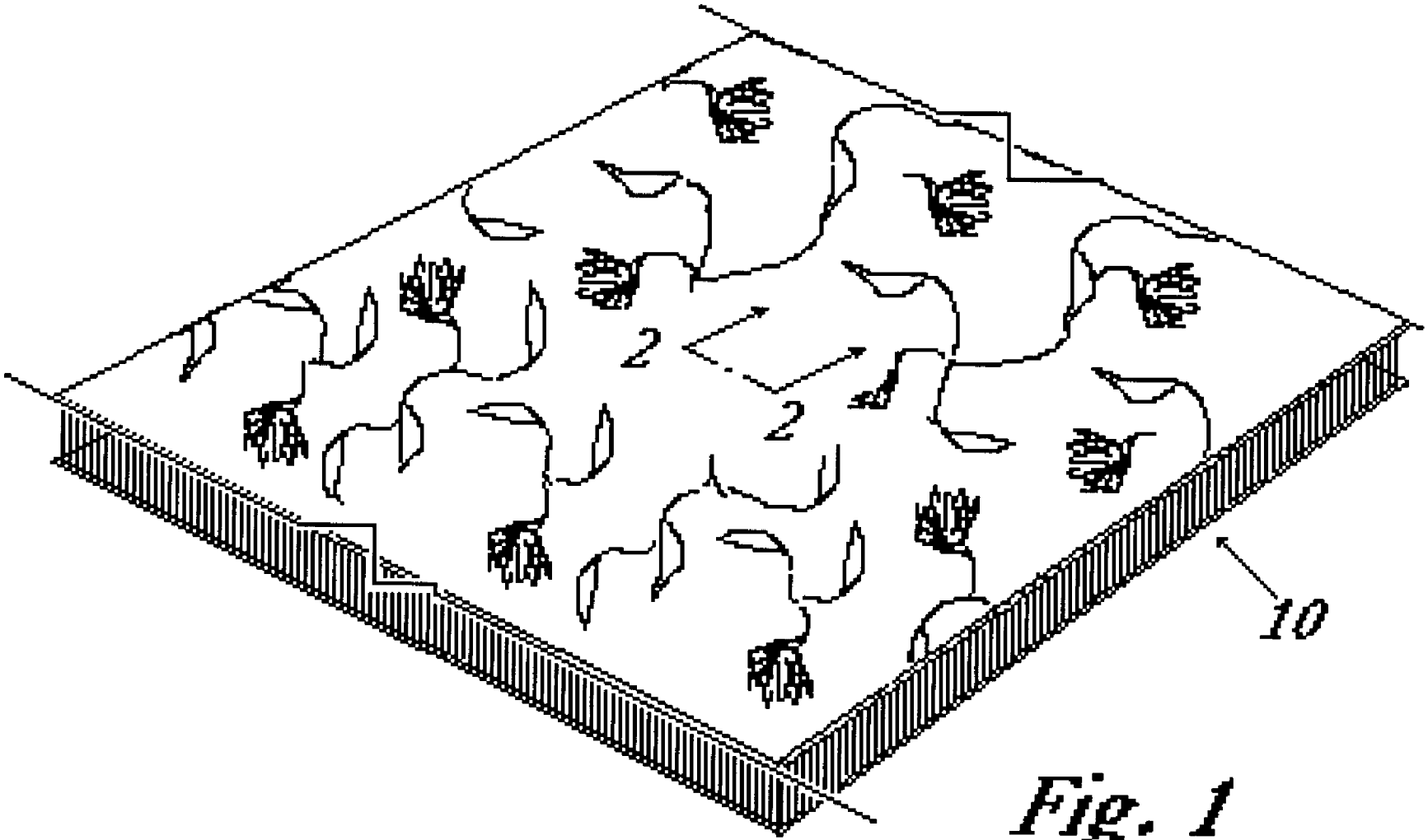
FIG. 1 is a perspective view of a piece of fabric according to an embodiment of the present invention.

In the drawings and the specification, there has been set forth preferred embodiments of the present invention and preferred embodiments, although specific terms are employed, the terms are used in a generic and descriptive sense only and not for the purpose of limitation. It should be understood that the foregoing descriptions and drawings, and examples are only illustrative of the present invention. Various alternatives and modifications thereof, can be devised by those skilled in the art without departing from the spirit and scope of the present invention. Accordingly, the present invention is intended to embrace all such alternatives, modifications, and variations that fall within the scope of the appended claims.

Figure 2:
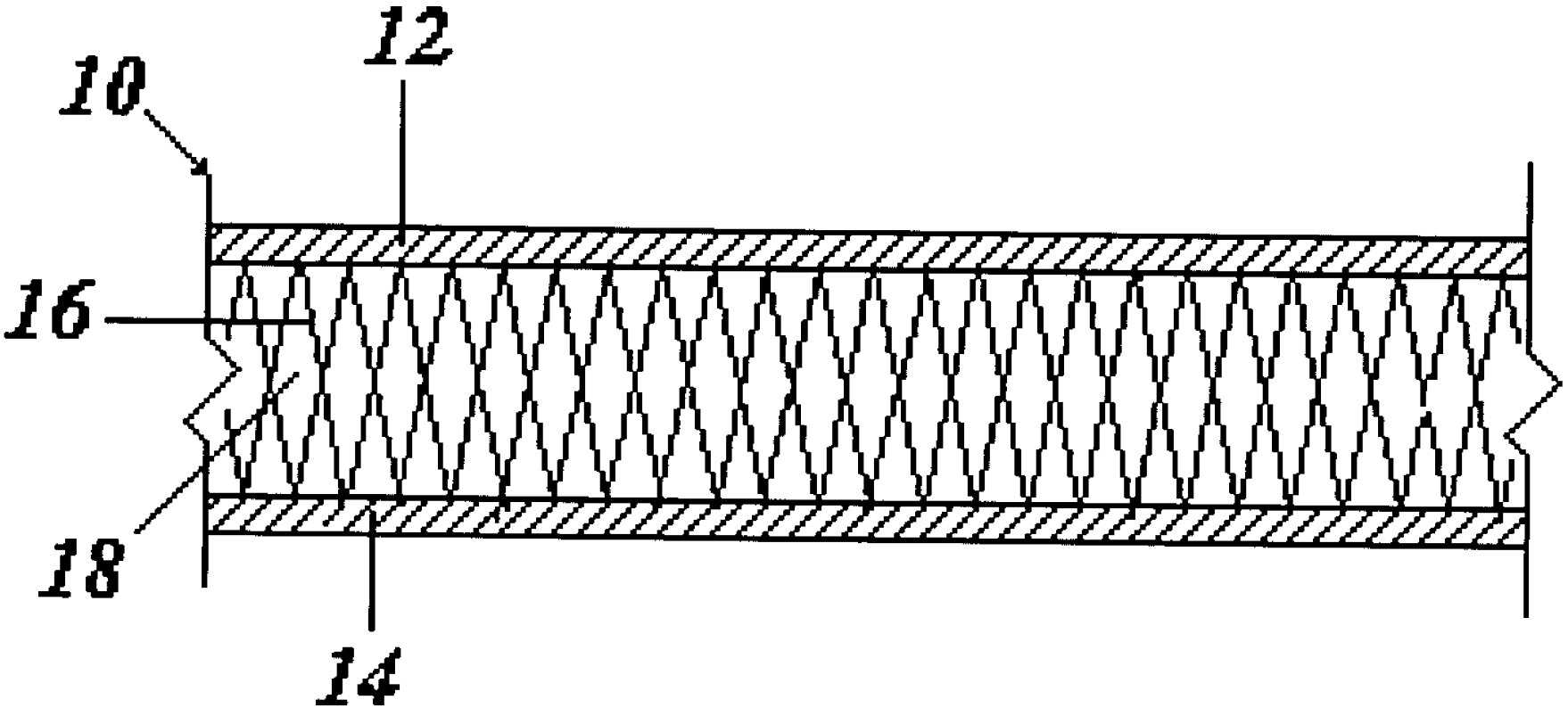
FIG. 2 is a cross-sectional view of the piece of fabric shown in FIG. 1, as taken along the line 2-2.

Referring now to the drawings, FIG. 1 illustrates a piece of weft-knitted, multilayer, spacer fabric with a Jacquard designed face fabric layer, shown generally at 10, according to the present invention. As illustrated in FIG. 2, which shows a cross-sectional view of the fabric in FIG. 1, the fabric 10 includes a first substantially decorative Jacquard pattern design layer 12 and a second substantially less decorative design layer. A plurality of spacer yarns 16 are secured within each of the respective knit fabric layers 12, 14, to maintain and secure each of the respective layers in a spaced relationship to each other. The space area 18 therefore is created between said first discrete fabric layer 12 and second discrete fabric layer 14 as illustrated in FIG. 2. The spacer yarns 16 are selected for their optimum resilience to bending through denier and filament count choice which will result in the first and second discrete fabric layers maintaining their spaced relationship as a unified composite fabric when subjected to stretching, or, when subjected to a heat-molding process. As illustrated in FIG. 1 and FIG. 2, fabric 10 shows a substantially decorative Jacquard design pattern integrally knitted onto the outer surface of first discrete fabric layer 12. The outer surface of the second discrete fabric layer 14 can be a substantially less decorative fabric layer.

In a preferred form of the invention, the yarns forming the first discrete knitted layer 12, i.e. the substantially decorativesurfaced Jacquard design pattern, are synthetic continuous-filament yarns such as those made from polymers such as nylon or polyester, or blends thereof, or the like. The yarns are described as desirably 20-200 denier multifilament nylon or polyester yarns, 10-70 denier spandex yarns, 18/1's-60/1's spun equivalent nylon, polyester, or cotton count, or blends or combinations thereof. Particularly preferred are combinations of textured multifilament semi-dull or matte luster yarns, spun yarns, and flat non textured bright cross-section luster multifilament yarns as the resultant extreme differences between the lusters of such yarns serve to accentuate the contrast between the pattern design motif and the surrounding ground knit areas. Elastomeric spandex yarns are integral to the fabric construction creating the desired amount of stretch needed for the end use application, as well as the recovery of the fabric from the amount of stretch imparted, and the spandex recovery force serves to enhance the spacer fabric composite thickness by enabling it to maintain the desired spaced relationship of the first and second discrete fabric layers The second discrete fabric layer 14, i.e. the substantially less decorative back or lining layer of the multi-layer spacer fabric is desirably knit from the same yarns as described for the first discrete fabric layer, and can either have a substantially fancy and decorative outer surface or one that is formed using a combination of stitches selected from a group consisting of simple knit, miss, or tuck. In one preferred fabric end use application, as described in FIGS. 8, 9, and 10, for example, said multi-layer spacer fabric is the primary substrate used as a molded breast cup for a brassiere; a desirable yarn selection for this fabric layer would be one of a relatively soft to the touch fine-filament yarn, preferably textured, and resulting in comfort against the skin of the wearer.

The spacer yarns 16 are made from materials capable of imparting resilience and resistance to deformation by use of continuous multifilament yarns preferably having a total denier and filament count which results in a substantial denier size per each filament, preferably in a range of 3-10 denier per filament. The yarns are described as desirably in a range of 70-300 denier continuous multifilament yarns such as polyester or nylon, or a monofilament polyester or nylon yarn in a range of 20-80 denier in size. A textured multifilament yarn is preferred, for example, as in the case of heat-molding to form a shaped breast cup component of a brassiere, and the fabric stretches to conform to the mold shape, a high population of fine filaments in the spacer layer 16 assures that the spacer composite does not sheer out and lose the desirable opacity in appearance of the finished molded cup part, and the subsequent finished brassiere garment.

Figure 3:
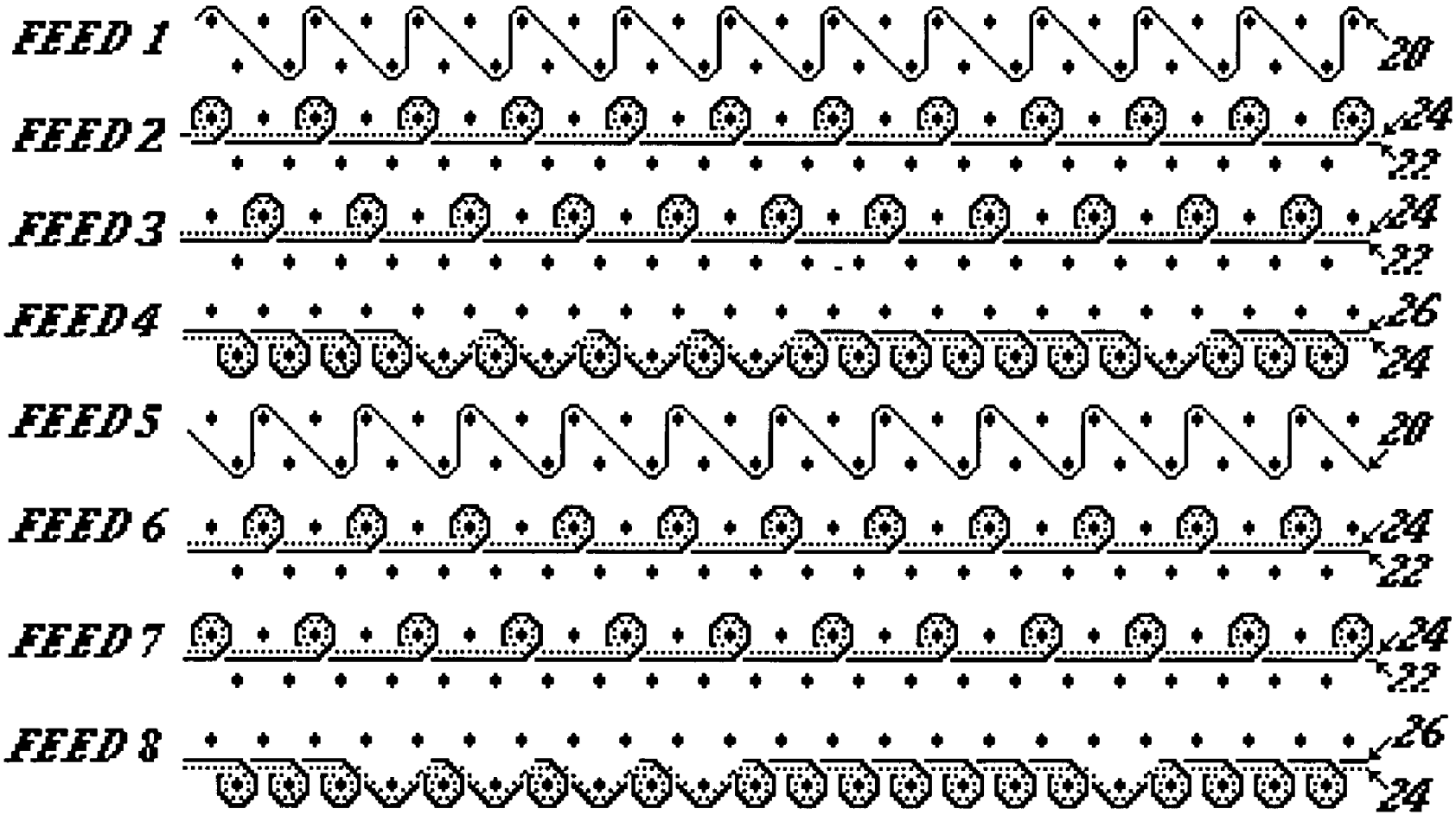
FIG. 3 shows an exemplary weft knitting sequence used in forming a fabric according to an embodiment of the present invention.

The method of producing the fabric 10 is desirably formed as follows, with particular reference to FIGS. 3-6. FIG. 3 illustrates an exemplary design pattern repeat for forming a fabric according to the present invention, with the needles of the knitting machine being arranged in a standard or rib gating. In this exemplary rib gated method the sequence of knitting uses every other or alternate needles of the cylinder and dial in forming the spacer connections. Feed 1 of the sequence illustrates the yarn 20 as it is fed in a reciprocating manner between the dial and cylinder needle beds only to every other needle of each bed; this yarn 20 will form the spacer yarns 16 in the fabric 10. Feeds 2 and 3 form the second discrete fabric layer on alternate needles of the dial from spandex yarns 24 that are plaited along with textured synthetic multifilament yarns 22, forming layer 14 in fabric 10. Feed 4 forms the first discrete fabric layer on the all cylinder needles incorporating the Jacquard design on the technical face through selection of knit or tuck stitches (taking care never to tuck on the same needle that the previous spacer yarn from feed 1 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 24 plaited with flat bright luster synthetic multifilament yarn 26, forming layer 12 in fabric 10. Feed 5 illustrates the spacer yarn 20 as it is fed in a reciprocating manner between the dial and cylinder needle beds to the alternate needles that were not fed yarn from feed 1, and forms spacer yarns 16 in fabric 10. Feeds 6 and 7 form the second discrete fabric layer on alternate needles of the dial from spandex yarns 24 plaited along with textured synthetic multifilament yarns 22. Feed 8 forms the first discrete fabric layer on all cylinder needles incorporating the Jacquard design on the technical face through selection of knit or tuck stitches and, just as in the case of Feed 4, taking care never to tuck on the same needle that the previous spacer yarn from feed 5 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 24 plaited with flat bright luster synthetic multifilament yarn 26, forming layer 12 in fabric 10.

Figure 4A:
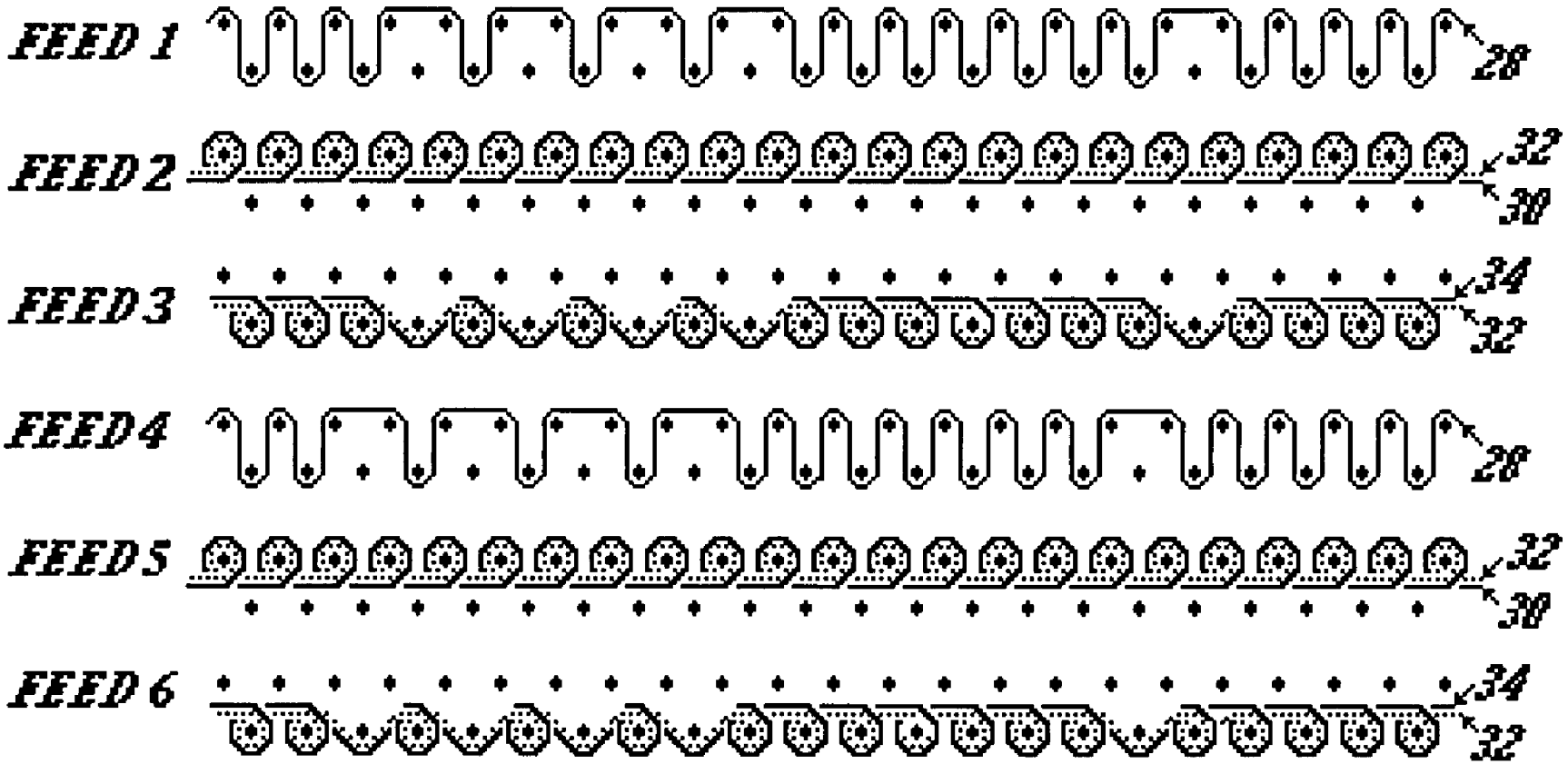
FIG. 4*a* shows an alternative weft knitting sequence for forming a fabric according to an embodiment of the present invention.
Figure 4B:
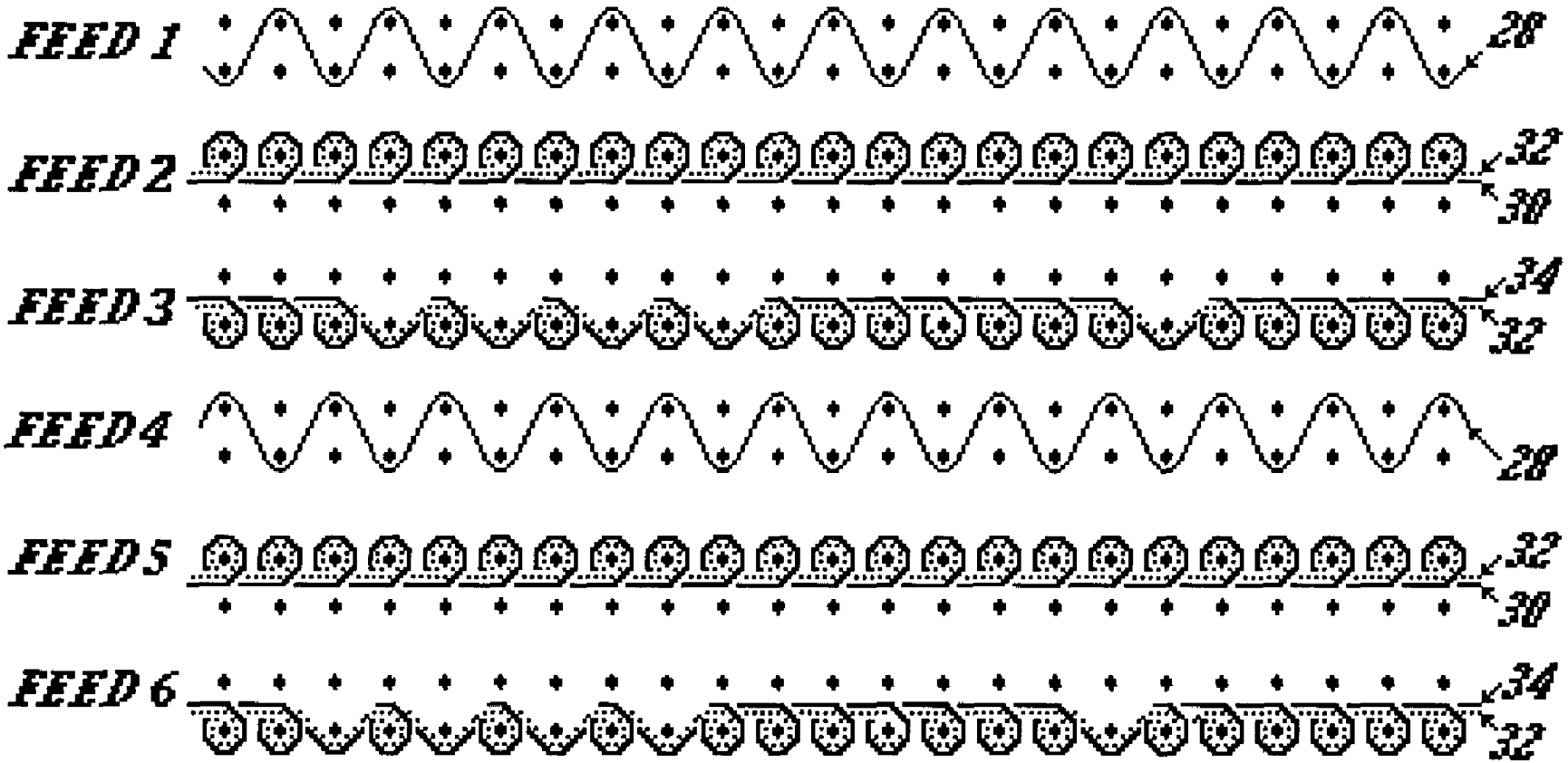
FIG. 4*b* shows an exemplary weft knitting sequence according to an embodiment of the present invention.

FIG. 4*a* illustrates an alternate method of knitting a fabric 10 according to the present invention with needles of the knitting machine arranged in a standard or rib gating, in this alternate method the sequence of knitting essentially uses all needles of both the dial and cylinder for forming the spacer connections. FIG. 4*b* illustrates an exemplary method of knitting a fabric 10 according to the present invention with needles of the knitting machine arranged in a standard Interlock opposed needle gating. In this exemplary method the sequence of knitting essentially uses only the alternate needles of both dial and cylinder for forming the spacer yarn connections. Now referring to FIG. 4*a*., Feed 1 of the sequence illustrates the resilient spacer yarn 28 as it is fed in a reciprocating manner between the dial and cylinder needle beds to essentially inlay tuck on all needles of both beds except on those particular needles whereby a Jacquard Feed 3 to follow it will be tucking; this yarn 28 will form the spacer yarns 16 in fabric 10. Referring to FIG. 4*b*, Feed 1 of the sequence illustrates the resilient spacer yarn 28 as it is fed in a reciprocating manner between the dial and cylinder needle beds to essentially inlay tuck on only every other or alternate needle of both the dial and cylinder needle beds thereby avoiding tucking on those particular needles whereby a Jacquard Feed 3 to follow will be tucking; this yarn 28 will form the spacer yarns 16 in fabric 10. In both FIG. 4*a* and FIG. 4*b*, Feed 2 forms the second discrete fabric layer on all dial needles from spandex yarn 32 that is plaited along with textured synthetic multifilament yarn 30, forming layer 14 in fabric 10. In both FIG. 4*a* and FIG. 4*b*, Feed 3 forms the first discrete fabric layer on all cylinder needles and incorporates the Jacquard design on the technical face through selection of knit or tuck stitches, taking care never to tuck on the same needle that the previous spacer yarn from Feed 1 was inlay tucked on due to the necessity for holding down the inlayed tuck spacer yarn on that needle with a subsequent knit stitch so as to keep it from rising up and moving out of the desired position to facilitate the exact knitting sequence and spacer yarn positioning, using spandex yarn 32 plaited along with a flat bright luster synthetic multifilament yarn 34. In FIG. 4*a*, Feed 4, like Feed 1, illustrates the spacer yarn as it is fed in a reciprocating manner between the dial and cylinder needle beds to essentially inlay tuck on all needles except on those particular needles whereby a Jacquard feed 6 to follow it will be tucking, this yarn 28 will form the spacer yarns 16 in fabric 10. In FIG. 4*b*, Feed 4, like Feed 1 of the sequence illustrates the resilient spacer yarn 28 as it is fed in a reciprocating manner between the dial and cylinder needle beds to essentially inlay tuck on only every other or alternate needle of both the dial and cylinder needle beds thereby avoiding tucking on those particular needles whereby a Jacquard Feed 6 to follow will be tucking; this yarn 28 will form the spacer yarns 16 in fabric 10. In FIG. 4*a* and FIG. 4*b* Feed 5, like Feed 2, forms the second discrete fabric layer on all dial needles from spandex yarn 32 that is plaited along with textured synthetic multifilament yarn 30, forming layer 14 in fabric 10. In both FIG. 4*a* and FIG. 4*b*, Feed 6, like feed 3, forms the first discrete fabric layer on all cylinder needles and incorporates the Jacquard design on the technical face through selection of knit or tuck stitches, taking care not to ever tuck on the same needle that the previous spacer feed 4 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning, using spandex yarn 32 plaited along with bright luster synthetic multifilament yarn 34.

Figure 5:
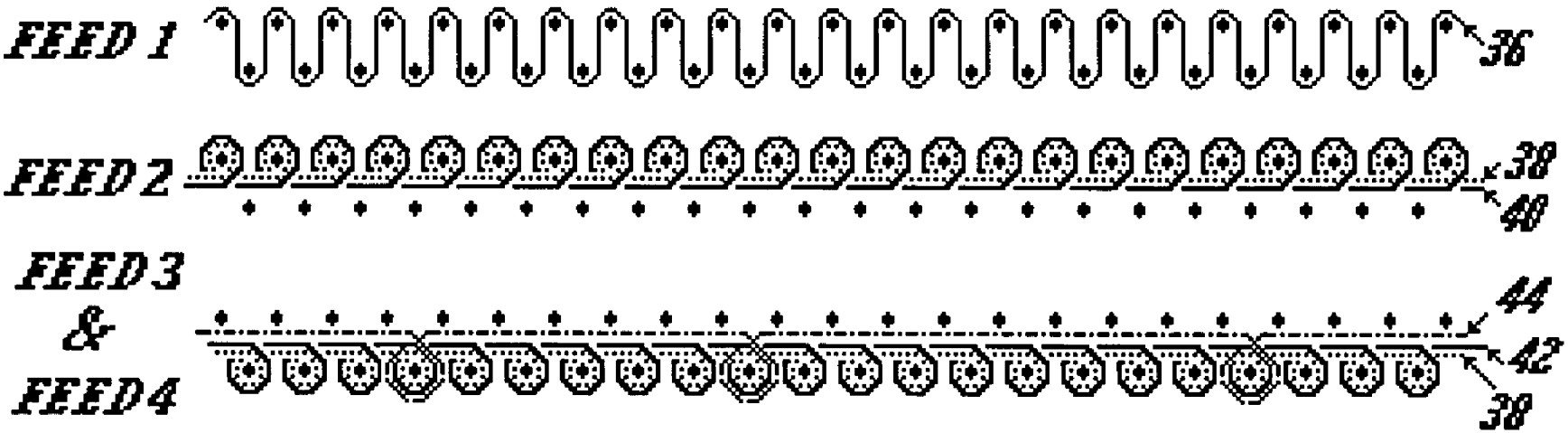
FIG. 5 shows a further alternative weft knitting sequence for forming a fabric according to an embodiment of the present invention.

FIG. 5 illustrates an alternate method of forming a fabric 10 according to the present invention with needles of the knitting machine arranged in a standard or rib gating, in this alternate method the sequence of knitting uses all dial and all cylinder needles for forming the spacer connections. Feed 1 of the sequence illustrates the resilient spacer yarn 36 as it is fed in a reciprocating manner between the dial and cylinder beds to essentially inlay tuck on all needles of both needle beds; this yarn 36, will form the spacer yarns 16 in fabric 10. Feed 2 forms the second discrete fabric layer on the dial needles from spandex yarn 38 that that is plaited along with textured synthetic multifilament yarn 40, forming discrete fabric layer 14 in fabric 10. Feed 3 forms the first discrete fabric layer on all needles of the cylinder from spandex yarn 38 plaited along with either a relatively fine denier bright, semi-dull, or dull matte luster synthetic continuous multifilament yarn 42.

Feed 3 is essentially used in a compounding relationship with Feed 4 in a manner to accomplish knitting a decorative Jacquard design into the first discrete fabric layer formed on the cylinder making fabric layer 12 of fabric 10, in that at Feed 3 the Cylinder needles are delayed to a one-half needle height with both yarns 38 and 42 placed under the hook of the needle, thus delaying the cast-off of the previous old yarn course stitches to allow time for the Jacquard effect yarn of Feed 4 to immediately follow Feed 3 yarn when the Jacquard design selection dictates placing yarn 44 from Feed 4 under the open hook of any risen needle that had been previously delayed to half height, according to the Jacquard design. Feed 4 preferably utilizes yarns that differ in size, texture, and luster characteristic from Feed 2 and Feed 3 insofar as the yarn may possess dyeing properties that differ from yarns in Feeds 2 and 3, e.g. spun staple yarn such as cotton, polyester, or nylon; continuous-filament acid or cationic dyeable nylon, and disperse or cationic dyeable polyester. Feed 4 illustrates yarn 44 as the Jacquard design effect yarn that follows a needle selection choice of either missing a needle or several needles in succession, essentially floating the effect yarn in the spacer layer 18 between the first and second discrete fabric layers 12 and 14 of fabric 10, or knitting on select needles so that when such select needles cast-off, both yarns from Feeds 3 and 4 on that select needle are cast-off simultaneously and the result is a stitch that positions the Jacquard yarn 44 in a plaited fashion on top of the differing ground yarns 38 and 42 and is positioned in front of the ground yarn when the fabric is viewed from the technical face of first discrete fabric layer 12 of fabric 10.

Figure 6:
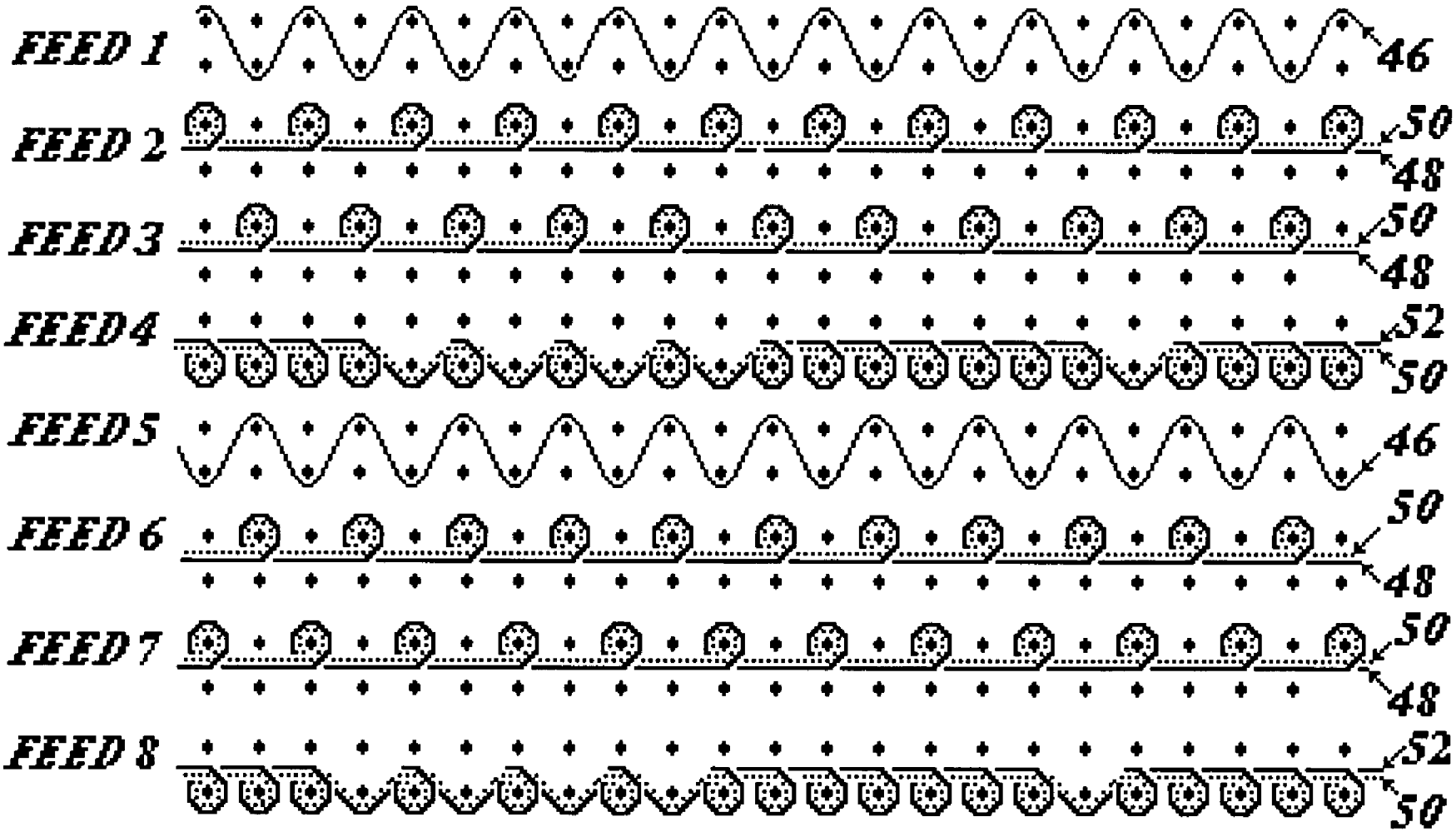
FIG. 6 shows another alternative weft knitting sequence for forming an embodiment of the present invention.

FIG. 6 illustrates an alternate Jacquard design pattern repeat for forming a fabric 10 according to the present invention with the needles of the knitting machine arranged in an Interlock opposed needle gating. In this alternate method, the sequence of knitting essentially uses every other or alternate needles of the cylinder and dial in forming the spacer connections. Feed 1 of the sequence illustrates the desired resilient yarn 46 as it is fed in a reciprocating manner between the dial and the cylinder needle beds only to every other needle of each bed; this yarn 46 will form the spacer yarns 16 in the fabric 10. Feeds 2 and 3 form the second discrete fabric layer on alternate needles of the dial from spandex yarns 50 that are plaited along with the textured synthetic multifilament yarns 48, forming fabric layer 14 in fabric 10. Feed 4 forms the first discrete fabric layer on all cylinder needles incorporating the Jacquard design on the technical face through selection of either knit or tuck stitches, taking care never to tuck on the same needle that the previous spacer yarn from Feed 1 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning, using the spandex yarn 50 plaited along with a desired flat bright luster synthetic multifilament yarn 52, forming layer 12 in fabric 10. Feed 5 illustrates the spacer yarn 46 as it is fed in a reciprocating manner between the dial and cylinder needle beds to the alternate needles that were not fed spacer yarn from Feed 1, and forms spacer yarns 16 in fabric 10. Feeds 6 and 7 form the second discrete fabric layer on alternate needles of the dial from spandex yarns 50 plaited along with textured synthetic multifilament yarns 48, forming layer 14 in fabric 10. Feed 8 forms the first discrete fabric layer on all cylinder needles incorporating the Jacquard design on the technical face through selection of knit or tuck stitches and, just as in the case of Feed 4, taking care never to tuck on the same needle that the previous spacer yarn from Feed 5 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning, using the spandex yarn 50 plaited along with flat bright luster synthetic multifilament yarn 52, forming layer 14 in fabric 10.

Figure 7:
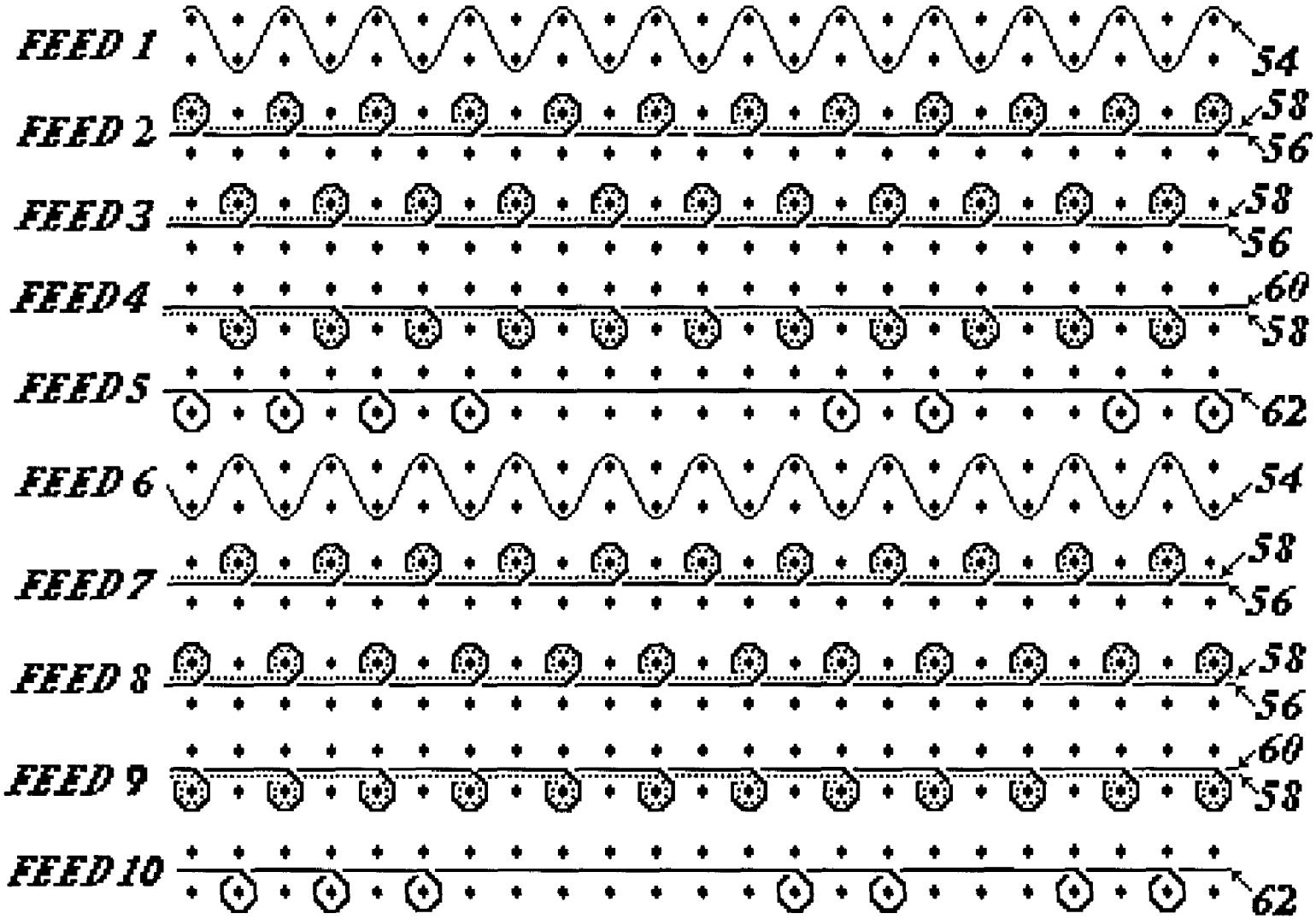
FIG. 7 shows a further exemplary weft knitting sequence for forming an embodiment of the present invention.

FIG. 7 illustrates an alternate Jacquard design pattern repeat for forming a fabric 10 according to the present invention with the needles of the knitting machine arranged in an standard Interlock opposed needle gating, in this alternate method the sequence of knitting essentially uses every other or alternate needles of the cylinder and dial in forming the spacer connections. Feed 1 of the sequence illustrates the desired resilient yarn 54 as it is fed in a reciprocating manner between the dial and cylinder needle beds only to every other needle of each bed; this yarn 54 will form the spacer yarns 16 of the fabric 10. Feeds 2 and 3 form the second discrete fabric layer on alternate needles of the dial from spandex yarns 58 that are plaited along with the synthetic textured multifilament yarns 56, forming fabric layer 14 in fabric 10. Feed 4 and Feed 5 combined together form the first discrete fabric layer on alternate needles of the cylinder incorporating the Jacquard design on the technical face. Feed 4 uses spandex yarn 58 plaited along with a preferred bright luster synthetic continuous multifilament yarn 60 and knits on every other needle of the cylinder. Feed 5 uses the Jacquard selected yarn which is preferably a semi-dull or matte luster textured synthetic continuous multifilament yarn 62, and knits on alternate cylinder needles from Feed 4 with Jacquard selection on certain cylinder needles to miss stitch knitting on those particular designated needles, and float in the spacer area until desirably to be knitted again according to the design preferences. This method of creating the Jacquard design in a spacer construction provides the ability to use two distinctly different yarns with diverse and contrasting properties on Feeds 4 and 5 allowing for maximum pattern definition and visual perception due to the fact that the relatively bright luster and preferably larger size yarn from Feed 4 is forced to make an elongated stitch which then allows more of the bright yarn to be placed on the surface of the technical face at Jacquard selected needles and the other non-selected needles will display the duller luster yarn from Feed 5 on every other needle of the cylinder in the ground areas of the design. The ground effect being there comprised of alternating stitches of bright and dull luster yarns. Feed 6 illustrates the spacer yarn 54 as it is fed in a reciprocating manner between the dial and cylinder needle beds to the alternate needles that were not feed spacer from previous Feed 1. Feeds 7 and 8 form the second discrete fabric layer on alternate needles of the dial, just as previously knitted Feeds 2 and 3, from spandex yarns 58 that are plaited along with the synthetic textured multifilament yarns 56, forming fabric layer 14 in fabric 10. Feeds 9 and 10 combined together form the first discrete fabric layer on alternate needles of the cylinder incorporating the Jacquard design on the technical face. Feed 9 uses spandex yarn 58 plaited along with a preferred bright luster synthetic continuous multifilament yarn 60 and knits on every other needle of the cylinder. Feed 10, as in Feed 5, uses the Jacquard selected yarn which is preferably a semi-dull or matte luster textured synthetic continuous multifilament yarn 62, and knits on alternate cylinder needles from Feed 9 with Jacquard selection on certain cylinder needles to miss stitch knitting on those particular designated needles, and float in the spacer area until desirably to be knitted again according to the design preferences as the Jacquard pattern is built gradually from knitting sequence repeat to repeat.

Figure 8:
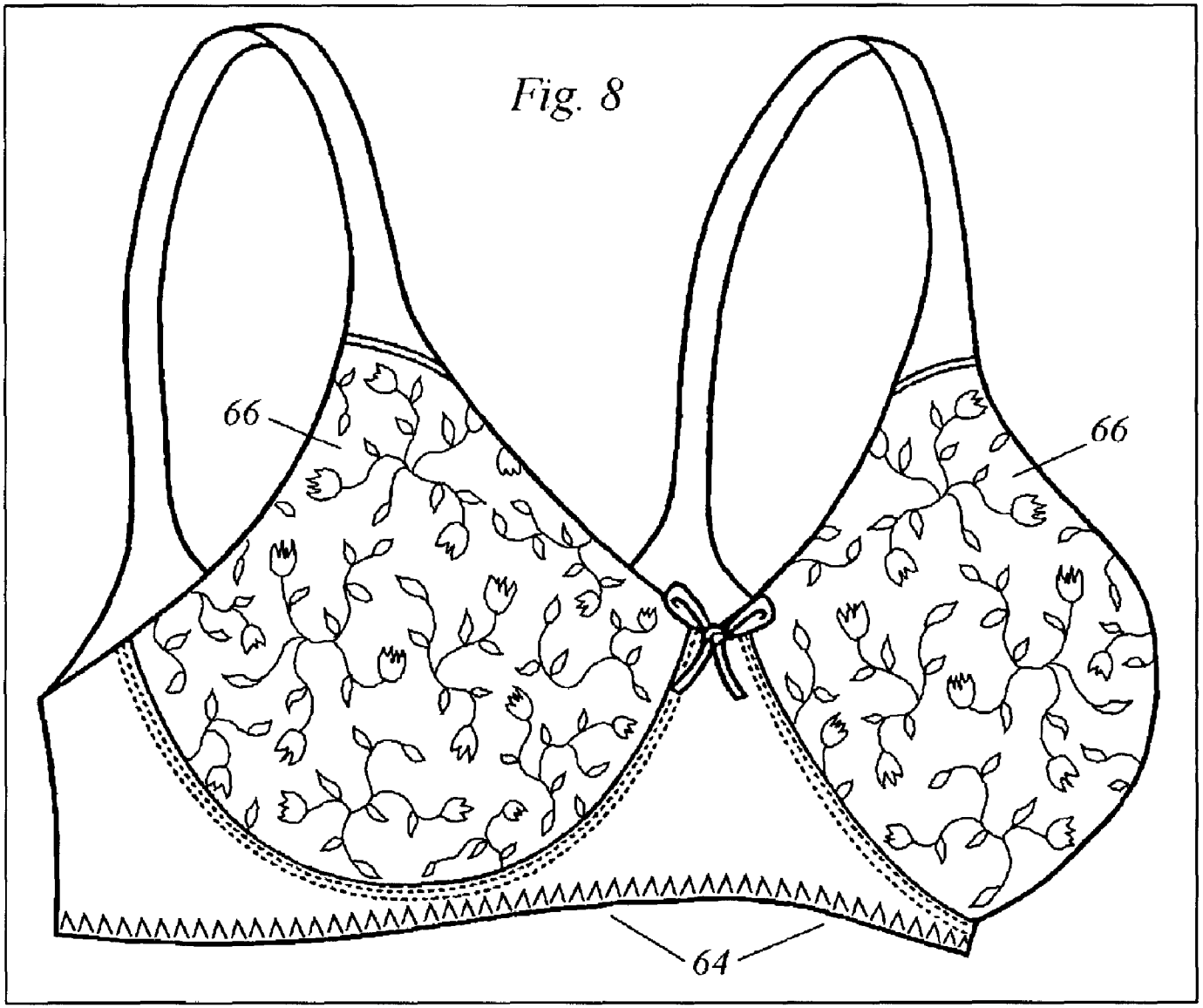
FIG. 8 shows an exemplary application in a brassiere intimate apparel garment utilizing an embodiment of the present invention.

FIG. 8 illustrates an exemplary perspective view of a brassiere generally represented as intimate apparel garment designated 64, utilizing the present invention. The weft knit spacer Jacquard design patterned outer face fabric composite 10 is shown as used for the cup portions 66, and at once serves as the outer decorative fabric, the spaced middle layer, and the inner fabric layer, all-in-one stretchable, heat-moldable composite fabric, instead of the garment manufacturer having to combine three or more different and separate components consisting of a decorative stylish outer face fabric, a middle layer of shaped foam or fiberfill padding, and a functional inner fabric lining layer.

Figure 9:
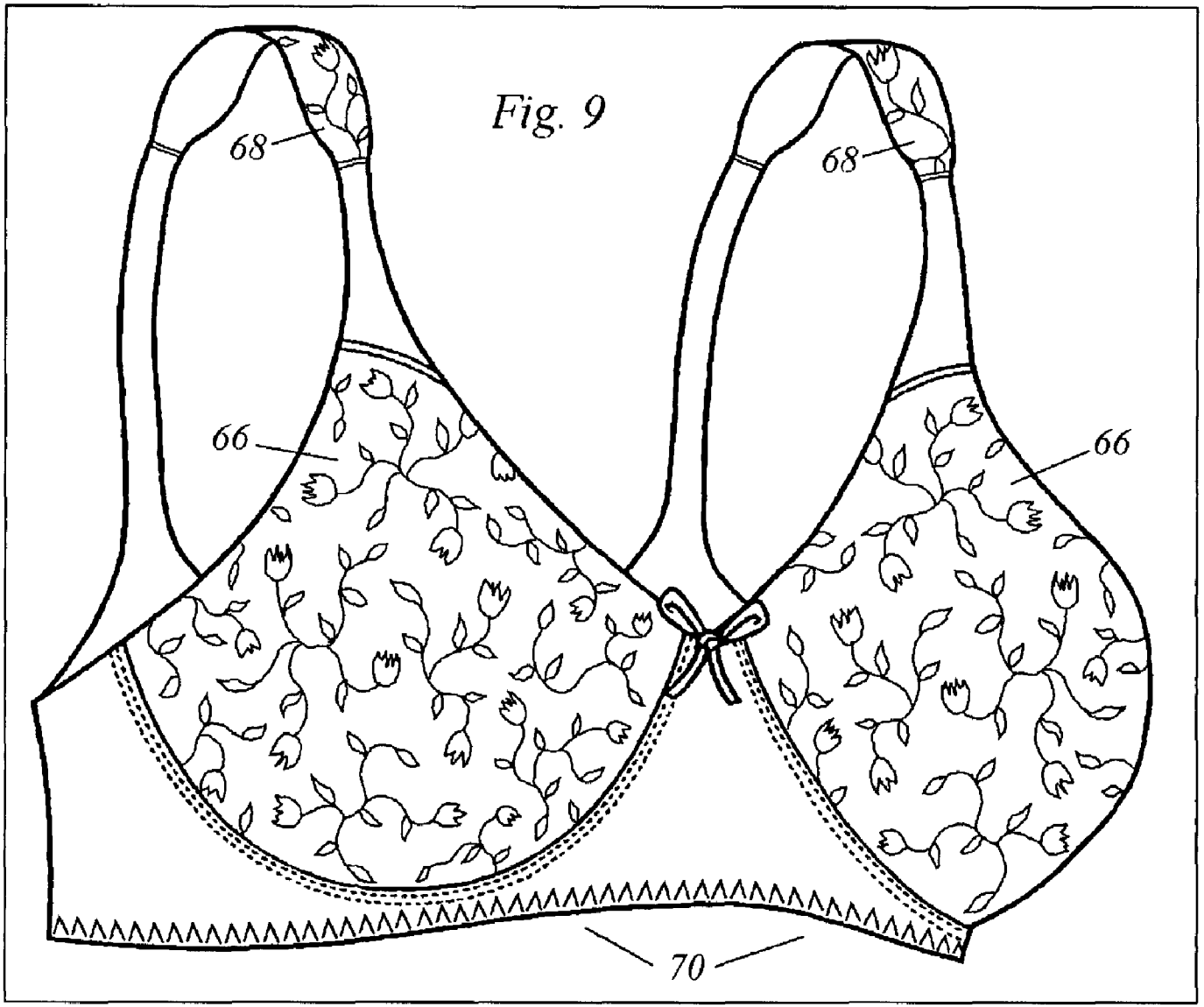
FIG. 9 shows an exemplary application on the present invention as a brassiere garment incorporating the present invention into decorative and functional shoulder strap portions of the brassiere of FIG. 8.

FIG. 9 illustrates an alternate embodiment of the brassiere in FIG. 8 which uses a unique wider width brassiere strap design 68 in brassiere 70 and incorporates the fabric 10 from FIG. 2 of the present invention into a matching or coordinating pattern as in 66 providing a decorative shoulder strap to the brassiere which in turn provides the garment wearer with a cushioning padded strap that is at once breathable and pleasingly decorative.

Figure 10:
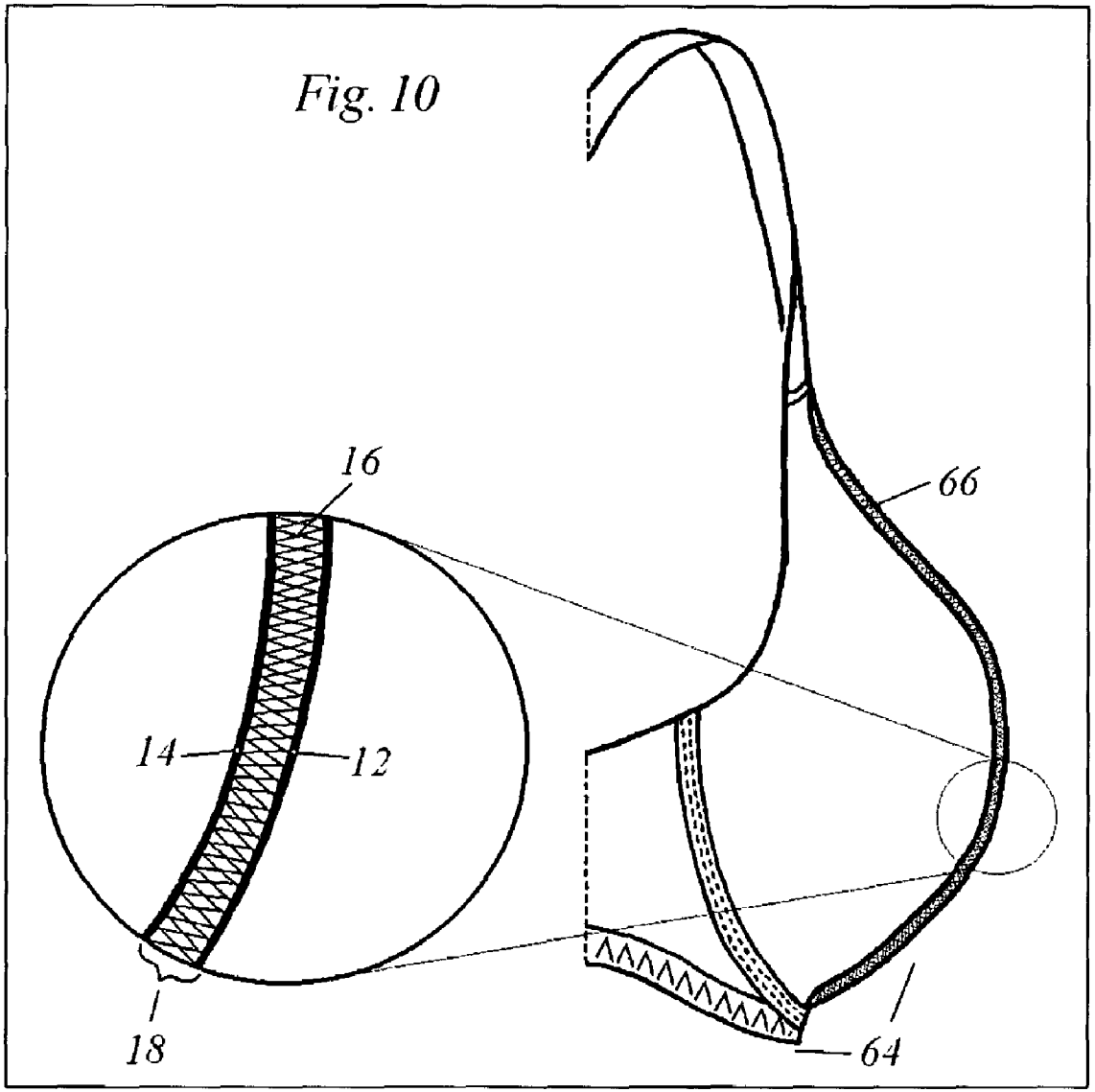
FIG. 10 shows a cross-section of the brassiere cup in FIGS. 8 and 9 detailing an embodiment of the present invention application.

FIG. 10 illustrates a cross-section cut away view of the brassiere 64 as viewed in FIG. 8, showing an embodiment of the present invention in an exemplary use as the brassiere breast cup component which serves to provide an outer decorative faced fabric layer 66, which is described as 12 of fabric 10 from FIGS. 1 and 2, and as viewed from the face of the garment; a spacer middle layer comprised of spacer yarns 16 forming spaced thickness area 18 as in FIG. 2; and a discrete inner cup lining fabric layer 14, which at once completes the brassiere cup construction in one unified integrally knitted weft knit spacer fabric composite thereby minimizing the number of steps in the garment manufacturing process by providing one multifunctional fabric substrate instead of the necessity of having to use three or more individual components for construction of the brassiere cup.

Figure 11:
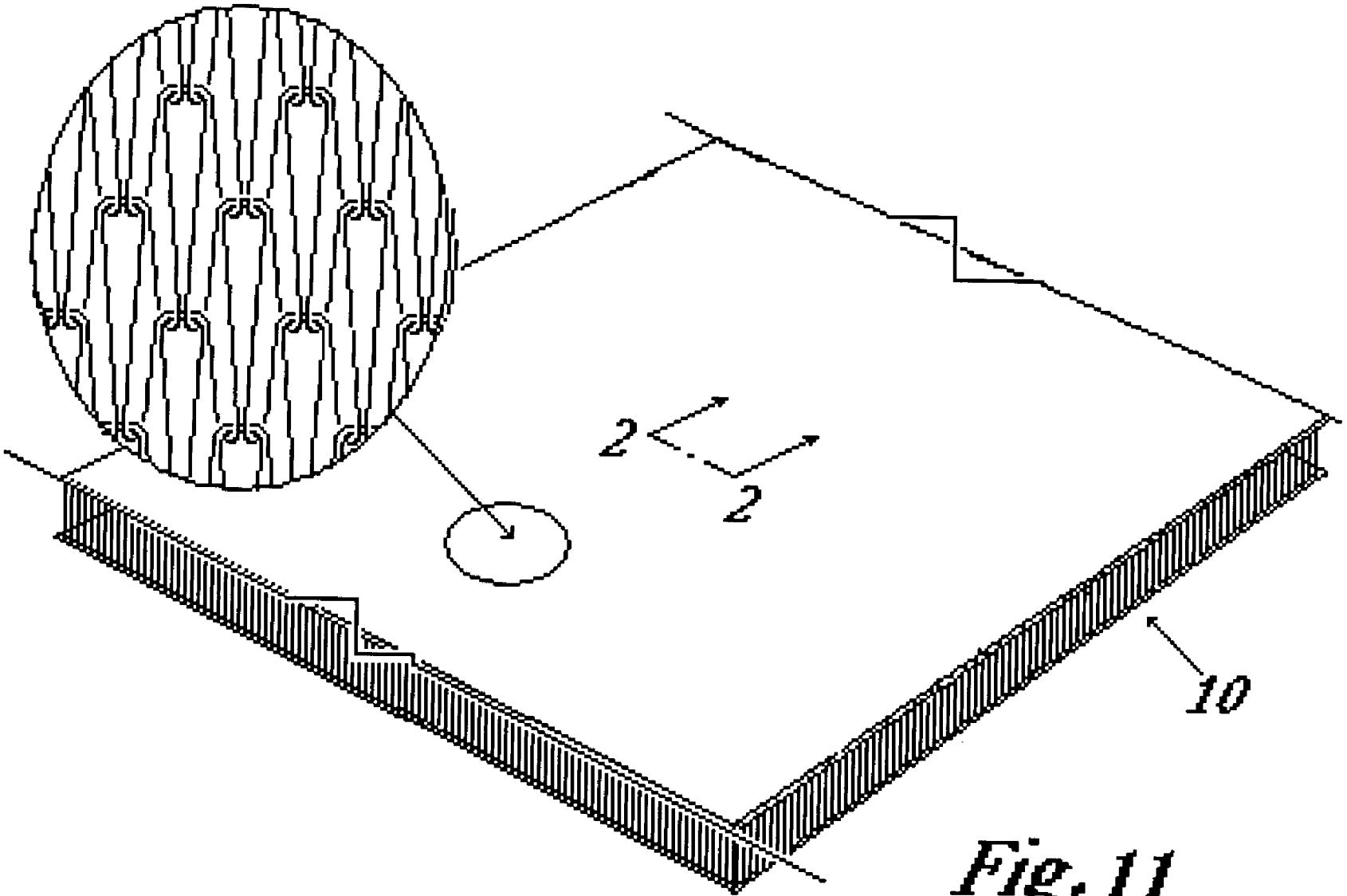
FIG. 11 is a perspective view of a piece of fabric according to an embodiment of the present invention.
Figure 12:
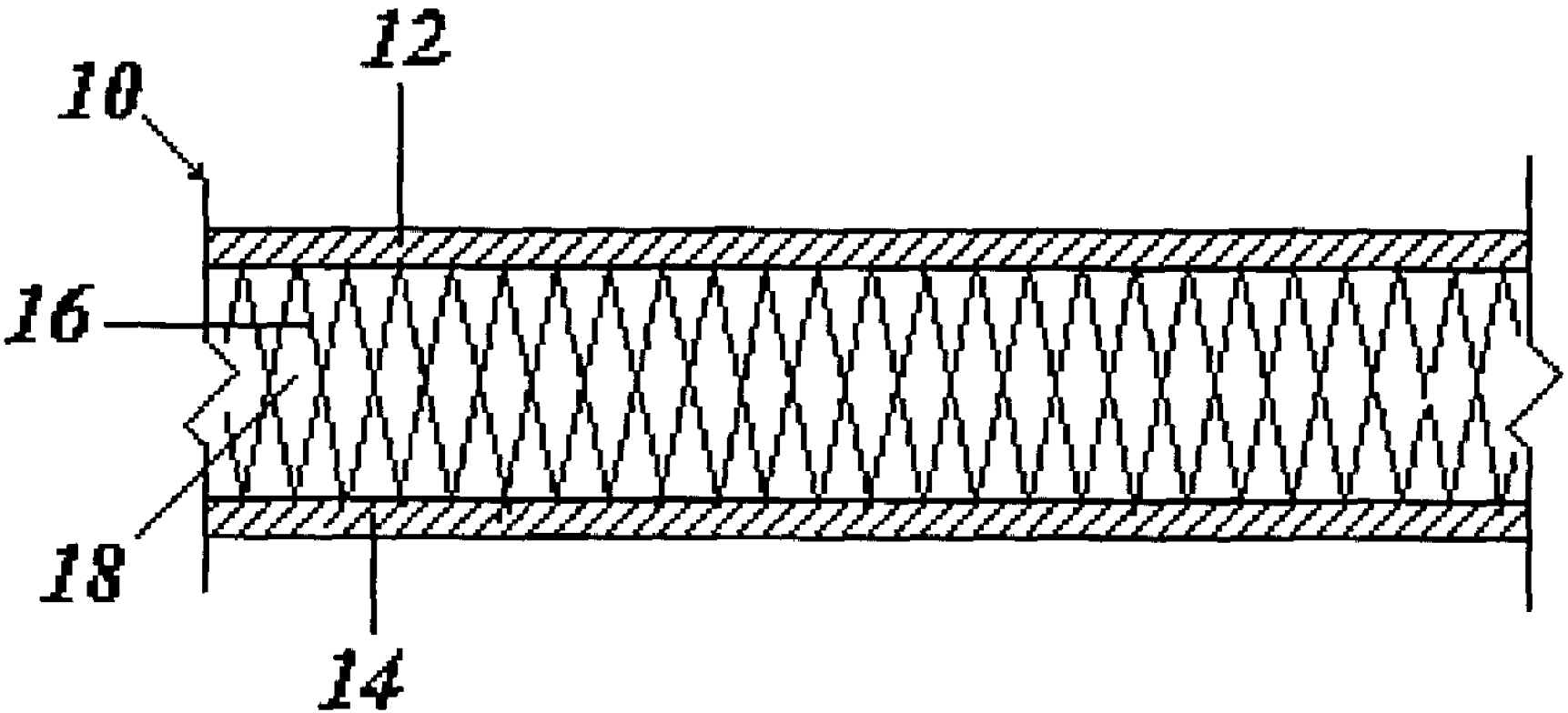
FIG. 12 is a cross-sectional view of the piece of fabric shown in FIG. 1, as taken along the line 2-2.

Referring now to the drawings, FIG. 11 illustrates a piece of weft-knitted, multi-layer, spacer fabric with a highly reflective and lustrous satin face fabric layer, shown generally at 2-2 of fabric 10, according to the present invention. As illustrated in FIG. 12, which shows a cross-sectional view of the fabric in FIG. 11, the fabric 10 includes a first substantially decorative highly lustrous satin effect layer 12 and a second substantially less decorative design layer 14. A plurality of spacer yarns 16 are secured within each of the respective knit fabric layers 12, 14, to maintain and secure each of the respective layers in a spaced relationship to each other. The space area 18 therefore is created between said first discrete fabric satin effect faced layer 12 and second discrete fabric layer 14 as illustrated in FIG. 12. The spacer yarns 16 are selected for their optimum resilience to bending through denier and filament count choice which will result in the first and second discrete fabric layers maintaining their spaced relationship as a unified composite fabric when subjected to stretching, or, when subjected to a heat-molding process. As illustrated in FIG. 11 and FIG. 12, fabric 10 shows a substantially decorative and highly lustrous satin effect integrally knitted onto the outer surface of first discrete fabric layer 12. The outer surface of the second discrete fabric layer 14 can be a substantially less decorative fabric layer, or may also be a bright highly lustrous satin effect outer face.

In a preferred form of the invention, the yarns forming the first discrete knitted layer 12, i.e. the substantially decorative lustrous satin effect layer, are synthetic continuous-filament yarns such as those made from polymers such as nylon or polyester, or blends thereof, or the like. The yarns are described as desirably 20-200 denier multifilament nylon or polyester yarns, 10-70 denier spandex yarns, or blends or combinations thereof. Particularly preferred are combinations of flat bright cross-section non-textured multifilament luster yarns to maximize the satin luster. Elastomeric spandex yarns are integral to the fabric construction creating the desired amount of stretch needed for the end use application, as well as the recovery of the fabric from the amount of stretch imparted, and the spandex recovery force serves to enhance the spacer fabric composite thickness by enabling it to maintain the desired spaced relationship of the first and second discrete fabric layers The second discrete fabric layer 14, i.e. the substantially less decorative back or lining layer of the multi-layer spacer fabric is desirably knit using yarns described as desirably 20-200 denier multifilament nylon or polyester yarns, 10-70 denier spandex yarns, 18/1's-60/1's spun equivalent nylon, polyester, or cotton count, or blends or combinations thereof. Particularly preferred are combinations of textured multifilament semi-dull or matte luster yarns, spun yarns, and can either have a substantially fancy and decorative outer surface or one that is formed using a combination of stitches selected from a group consisting of simple knit, miss, or tuck. In one preferred fabric end use application, as described in FIGS. 15, and 16, for example, said multi-layer spacer fabric is the primary substrate used as a molded breast cup for a brassiere, a desirable yarn selection for this fabric layer 14 would be one of a relatively soft to the touch fine multifilament yarn, preferably textured, and preferably a micro denier, resulting in a comfort lining layer against the skin of the wearer.

The spacer yarns 16 are made from materials capable of imparting resilience and resistance to deformation by use of continuous multifilament yarns preferably having a total denier and filament count which results in a substantial denier size per each filament, preferably in a range of 2-10 denier per filament. The yarns are described as desirably in a range of 70-300 denier continuous multifilament yarns such as polyester or nylon, or a monofilament polyester or nylon yarn in a range of 20-80 denier in size. A textured multifilament yarn is preferred, for example, as in the case of heat-molding to form a shaped breast cup component of a brassiere, and the fabric stretches to conform to the mold shape, a high population of fine filaments in the spacer layer 16 assures that the spacer composite does not sheer out and lose the desirable opacity in appearance of the finished molded cup part, and the subsequent finished brassiere garment.

The method of producing the fabric 10 is desirably formed as follows, with particular reference to FIG. 13*a*. FIG. 13*a* illustrates an exemplary and preferred design knitting sequence pattern repeat for forming a fabric according to the present invention, with the needles of the knitting machine being arranged in a standard interlock gating. Both the cylinder and the dial are set up with an alternating short and long needle arrangement. In this exemplary method the sequence of knitting uses every other or alternate short (S) or long (L) needles of the cylinder and dial in forming the spacer connections. Feed 1 of the sequence illustrates the spacer yarn 28 as it is fed in a reciprocating manner between the dial and cylinder needle beds only to every other short (S) needle of each bed; this highly resilient yarn 28 will form the spacer yarns 16 in the fabric 10. Feed 2 forms the second discrete fabric layer on all alternating short and long needles of the dial from spandex yarns 32 that are plaited along with textured synthetic multifilament yarns 30, forming layer 14 in fabric 10. Yams 30 are preferably comprised of a relatively high number of filaments or even a micro denier, as the second distinct fabric layer 14 may be used as the inner lining side of a molded brassiere breast cup and shall be soft and comfortable against the skin of the wearer. Feed 3 forms the first discrete fabric layer on the all cylinder needles incorporating a stitch combination that forces longer individual stitch leg length floats, thus creating a satin effect on the technical face through selection of alternating knit on short needles and tuck on long needle stitches (taking care never to tuck on the same needle of the dial that the previous spacer yarn from feed 1 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 32 plaited with flat bright luster synthetic multifilament yarn 34, forming layer 12 in fabric 10. Feed 4 illustrates the highly resilient spacer yarn 28 as it is fed in a reciprocating manner between the dial and cylinder needle beds to the alternate long (L) needles that were not fed yarn from feed 1, and forms spacer yarns 16 in fabric 10. Feed 5, just like Feed 2, forms the second discrete fabric layer on all alternating short (S) and long (L) needles of the dial from spandex yarns 32 that are plaited along with textured synthetic multifilament yarns 30, forming layer 14 in fabric 10. Feed 6, just like Feed 3, forms the first discrete fabric layer on the all cylinder needles incorporating a stitch combination that forces longer individual stitch leg length floats, thus creating a satin effect on the technical face through selection of alternating knit on long (L) needles and tuck on short (S) needles of the cylinder forming stitches that create the first discrete satin fabric layer on all cylinder needles (and, just as in the case of Feed 3, taking care never to tuck on the same needle that the previous spacer yarn from feed 4 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 32 plaited with flat bright luster synthetic multifilament yarn 34, forming layer 12 in fabric 10.

FIG. 13*b* illustrates an exemplary and alternately preferred design knitting sequence pattern repeat for forming a fabric according to the present invention, with the needles of the knitting machine being arranged in a standard interlock gating. Both the cylinder and the dial are set up with an alternating short and long needle arrangement. The resultant construction hereby described will produce a high lustrous satin face on both first and second discrete fabric layers knitted from the cylinder and dial needles and connected by the spacer yarns as in FIG. 13. In this exemplary method the sequence of knitting uses every other or alternate short (S) or long (L) needles of the cylinder and dial in forming the spacer connections. Feed 1 of the sequence illustrates the yarn 28 as it is fed in a reciprocating manner between the dial and cylinder needle beds only to every other short (S) needle of each bed; this highly resilient yarn 28 will form the spacer yarns 16 in the fabric 10. Feed 2 forms the second discrete fabric layer on all alternating short and long needles of the dial from spandex yarns 32 that are plaited along with bright luster flat synthetic multifilament yarns 34, forming layer 14 in fabric 10. Yarns 34 are preferably comprised of a denier and filament count that are both tactile and bright in luster as the second distinct fabric layer 14 may be used as the inner lining side of a molded brassiere breast cup and shall be soft and comfortable against the skin of the wearer. Feed 2 forms the second discrete fabric layer on the all dial needles incorporating a stitch combination that forces longer individual stitch leg length floats, thus creating a satin effect on the technical face of the dial knitted fabric layer through selection of alternating tuck on long (L) needles and knit on short (S) needles of the dial (taking care never to tuck on the same needle of the dial that the previous spacer yarn from feed 1 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 32 plaited with flat bright luster synthetic multifilament yarn 34, forming layer 12 in fabric 10. Feed 3 forms the first discrete fabric layer on the all cylinder needles incorporating a stitch combination that forces longer individual stitch leg length floats, thus creating a satin effect on the technical face through selection of alternating knit on short (S) needles and tuck on long (L) needles of the cylinder (taking care never to tuck on the same needle of the cylinder that the previous spacer yarn from feed 1 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 32 plaited with flat bright luster synthetic multifilament yarn 34, forming layer 12 in fabric 10. Feed 4 illustrates the highly resilient spacer yarn 28 as it is fed in a reciprocating manner between the dial and cylinder needle beds to the alternate long (L) needles that were not fed yarn from feed 1, and forms spacer yarns 16 in fabric 10. Feed 5, just like Feed 2, forms the second discrete fabric layer on all dial needles incorporating a stitch combination that forces longer individual stitch leg length floats, thus creating a satin effect on the technical face of the dial knitted fabric layer through selection of alternating knit on long (L) needles and tuck on short (S) needles of the dial knitted fabric (taking care never to tuck on the same needle of the dial that the previous spacer yarn from feed 4 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) forms the second discrete fabric layer on all needles of the dial from spandex yarns 32 that are plaited along with bright flat synthetic multifilament yarns 34, forming layer 14 in fabric 10. Feed 6, just like Feed 3, forms the first discrete fabric layer on the all cylinder needles incorporating a stitch combination that forces longer individual stitch leg length floats, thus creating a satin effect on the technical face of the cylinder produced fabric layer through selection of alternating knit on long (L) needles and tuck on short (S) needles of the cylinder forming stitches that create the first discrete satin fabric layer on all cylinder needles (and, just as in the case of Feed 3, taking care never to tuck on the same needle that the previous spacer yarn from feed 4 was inlay tucked on due to the necessity for holding down the inlayed tuck spacer yarn on that needle with a subsequent knit stitch so as to keep it from rising up and moving out off the desired position to facilitate the exact knitting sequence and spacer yarn positioning) using the spandex yarn 32 plaited with flat bright luster synthetic multifilament yarn 34, forming layer 12 in fabric 10.

Figure 14:
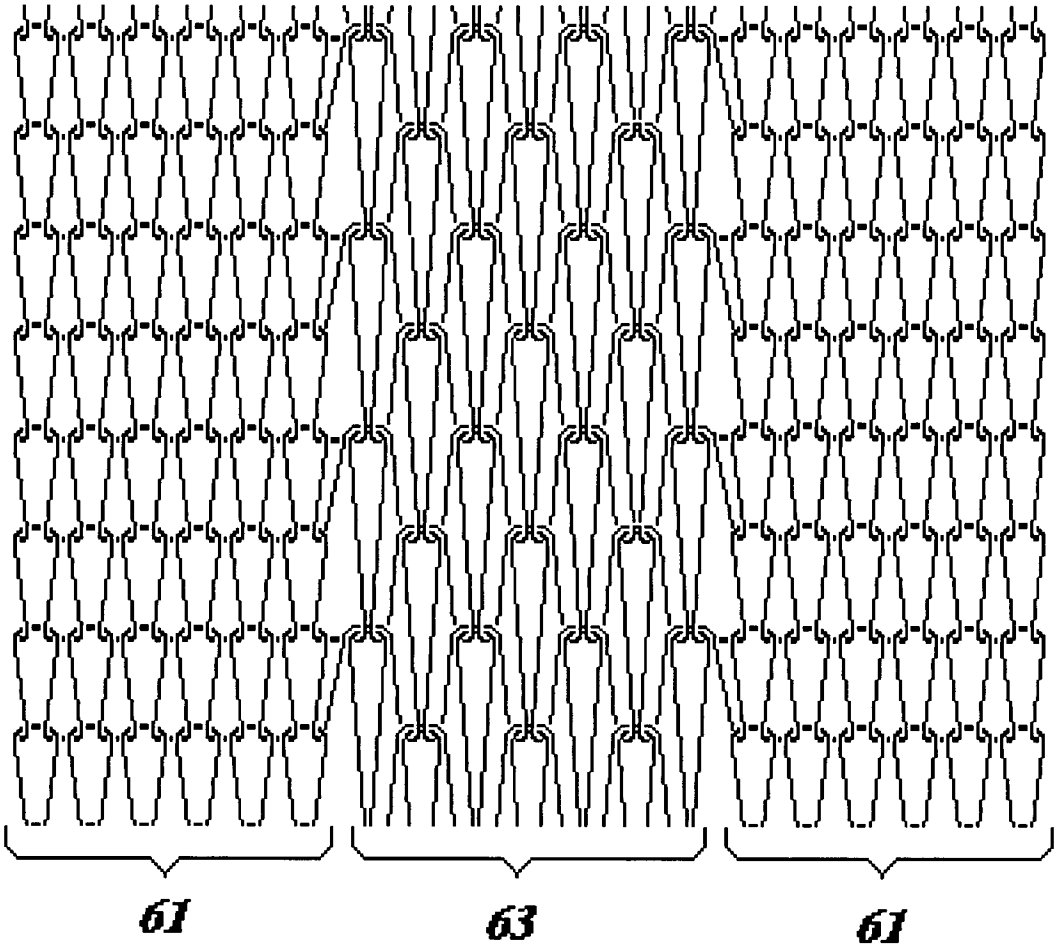
FIG. 14 illustrates a weft-knitting stitch diagram according to a preferred embodiment of the present invention as disclosed in FIG. 13*a*.

FIG. 14 graphically illustrates the extended lengths of the legs of the plain knitted stitches creating a satin surface 63 when a combination of alternate knit and tuck stitches are employed. The stitch leg lengths are essentially twice the length of those stitch legs formed when knitting in a plain all knit jersey sequence 61.

Figure 15:
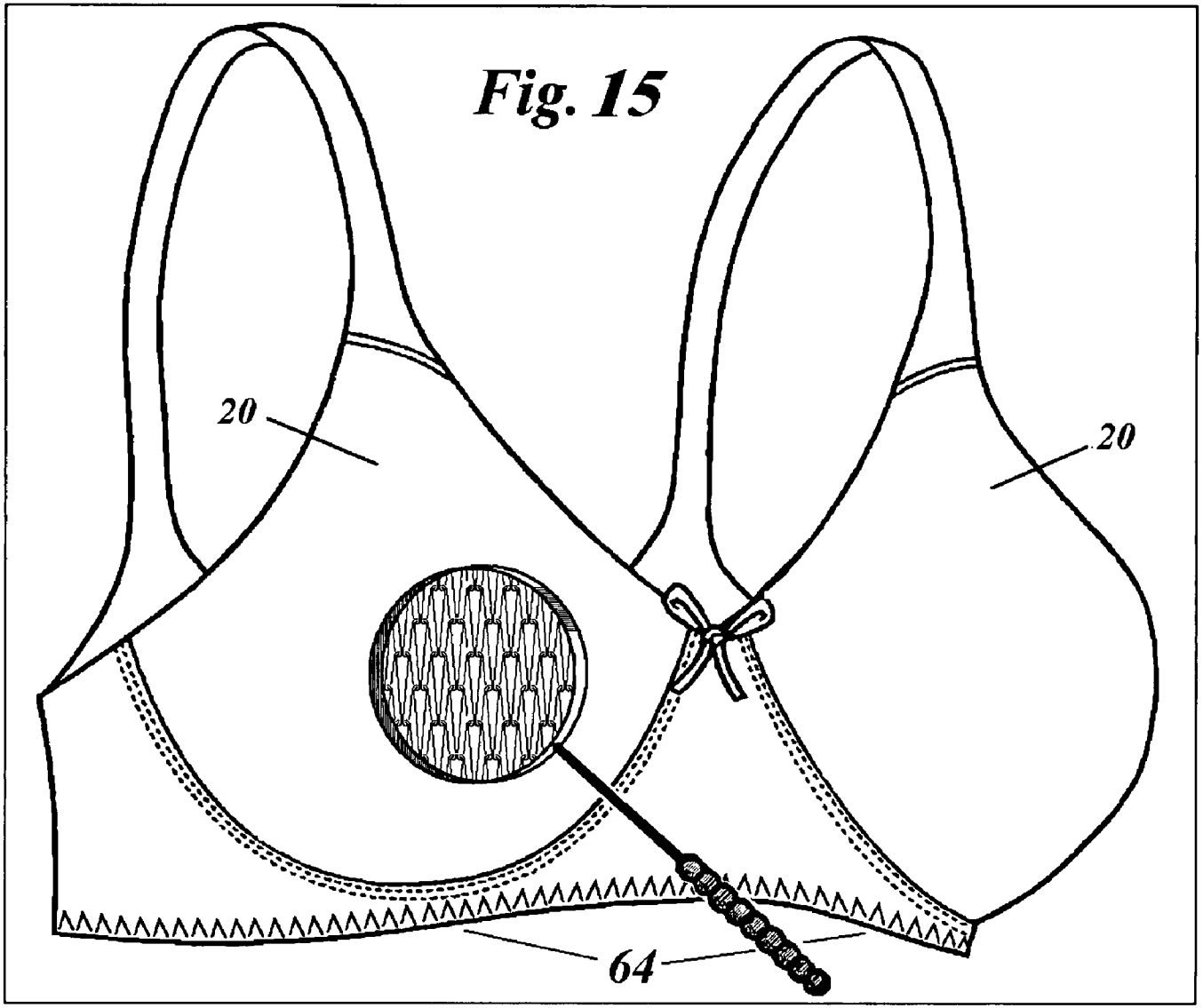
FIG. 15 shows an exemplary application in a brassiere intimate apparel garment utilizing an embodiment of the present invention.

FIG. 15 illustrates an exemplary perspective view of a brassiere generally represented as intimate apparel garment designated 64, utilizing the present invention. The weft knit spacer satin effect outer face fabric layer 12 in fabric composite 10 is shown as used for the cup portions 20 in brassiere 64, and at once serves as the outer decorative satin faced fabric, the spaced middle layer, and the inner fabric layer, all-in-one stretchable, heat-moldable composite fabric, instead of the garment manufacturer having to combine three or more different and separate components consisting of a decorative stylish outer face fabric, a middle layer of shaped foam or fiberfill padding, and a functional inner fabric lining layer.

Figure 16:
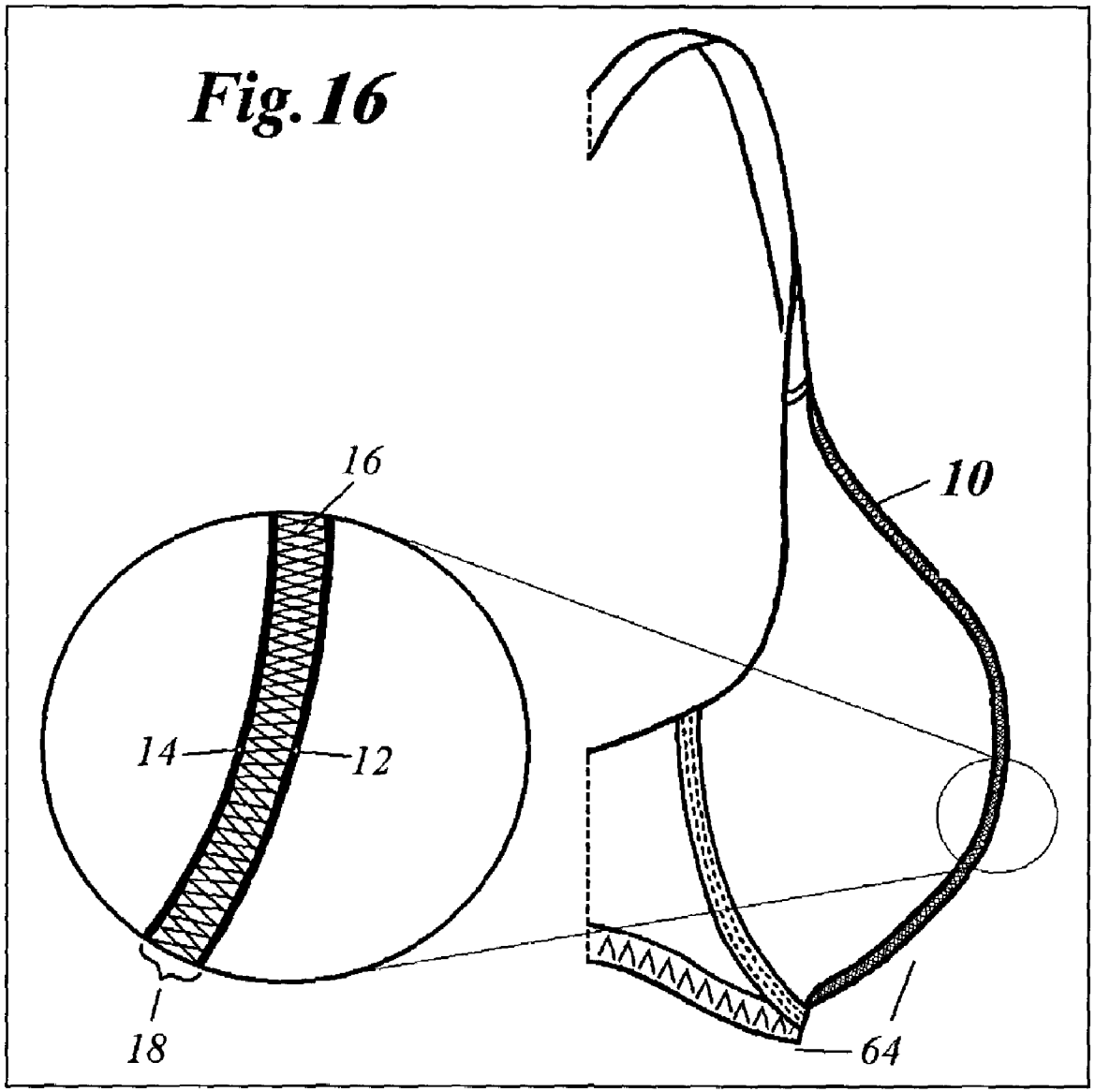
FIG. 16 shows a cross-section of the brassiere cup in FIG. 15 detailing an embodiment of the present invention application.

FIG. 16 illustrates a cross-section cut away view of the brassiere 64 as viewed in FIG. 15, showing an embodiment of the present invention in an exemplary use as the brassiere breast cup component which serves to provide; an outer decorative satin faced fabric layer which is described as 12 of fabric 10 from FIGS. 11 and 12, and as viewed from the face of the garment, a spacer middle layer comprised of spacer yarns 16 forming spaced thickness area 18 as in FIG. 12, and a discrete inner cup lining fabric layer 14, which at once completes the brassiere cup construction in one unified integrally knitted weft knit spacer fabric composite thereby minimizing the number of steps in the garment manufacturing process by providing one multifunctional fabric substrate instead of the necessity of having to use three or more individual components for construction of the brassiere cup.

Certain modifications and improvements will occur to those skilled in the art upon a reading of the foregoing description. By way of example, additional embodiments of printing, embossing, emboss printing, laser engraving, and/or multi-component yarns for heather effect or marled fabric surface designs, and combinations thereof, as well as other decorative-faced fabric designs, either by color, texture, appearance, feel, surface smoothness or roughness, and the like are further contemplated by and fall within the scope of the present invention. All modifications and improvements have been deleted herein for the sake of conciseness and readability but are properly within the scope of the following claims.

What is claimed is:

1. A multi-layer, weft knit, spacer fabric comprising:

a first substantially decorative design, weft knit, discrete fabric layer comprising an elastomeric yarn;

a second, weft knit, discrete fabric layer comprising an elastomeric yarn and having a different construction than the first layer; and a plurality of resilient, multi-filament, textured spacer yarns secured within the knit structure of each of said first and second layers and extending between the layers to secure the layers in a spaced relationship and separated from each other, wherein a spacer yarn of the plurality of spacer yarns is tucked into the first layer by a first feed, wherein the elastomeric yarn of the first layer is fed by a subsequent feed with selected knit and tuck stitches, wherein the elastomeric yarn of the first layer is not tucked where the spacer yarn of the first feed is tucked, wherein the spacer fabric is heat moldable, wherein the elastomeric yarns of the first and second layers enhance a thickness of the spaced relationship of the first and second layers, and wherein the spacer yarns maintain opacity in the heat molded fabric.

2. The fabric according to claim 1, wherein said first weft knit discrete fabric layer comprises knit and tuck stitches.

3. The fabric according to claim 1 wherein said second weft knit discrete fabric layer comprises knit, miss, and/or tuck stitches.

4. The fabric according to claim 1, wherein said first weft knit discrete fabric layer comprises at least one yarn, the yarn comprising spandex, nylon, polyester, and/or blends thereof.

5. The fabric according to claim 1, wherein said second weft knit discrete fabric layer comprises at least one yarn, the yarns comprising spandex, nylon, polyester, cotton, and/or blends thereof.

6. The fabric according to claim 1, wherein said plurality of spacer yarns securing the first and second fabric layers in a spaced relationship comprises a continuous-filament synthetic yarn.

7. The fabric according to claim 5, wherein said spacer yarns comprise polyester or nylon.

8. The fabric according to claim 1 wherein said first and second discrete weft knit layers comprise elastomeric spandex yarn in a range of between about 20 to about 70 denier in size.

9. The fabric according to claim 1 wherein said first and second discrete weft knit fabric layers comprise continuous multifilament synthetic yarns in a range of between about 20 to about 200 denier in size.

10. The fabric according to claim 1 wherein said spacer yarns comprise a substantially resilient continuous monofilament yarn in a range of between about 10 to about 80 denier in size.

11. The fabric according to claim 1 wherein said spacer yarns comprise a substantially resilient continuous multifilament yarn in a range of between about 70 to about 300 denier in size.

12. The fabric according to claim 1 wherein said second discrete fabric layer comprises spun yarn counts in a range of between about 18/1's to about 60/1's yarn equivalent.

13. The fabric according to claim 1, wherein the first weft knit discrete fabric layer comprises a jacquard design and wherein the elastomeric yarn of the first layer is plated.

14. An article of manufacture comprising the fabric of claim 1.

15. A method of forming a multi-layer, weft-knit spacer fabric comprising the steps of:

knitting a spacer fabric having a first substantially decorative design, weft knit, discrete fabric layer comprising an elastomeric yarn, a second weft knit, discrete fabric layer comprising an elastomeric yarn and having a different construction than the first layer, and a plurality of resilient, multi-filament, textured spacer yarns secured within the knit structure of each of said first and second layers and extending between the layers to secure the layers in a spaced relationship and separated from each other, wherein a spacer yarn of the plurality of spacer yarns is tucked into the first layer by a first feed, wherein the elastomeric yarn of the first layer is fed by a subsequent feed with selected knit and tuck stitches, wherein the elastomeric yarn of the first layer is not tucked where the spacer yarn of the first feed is tucked, wherein the elastomeric yarns of the first and second layers enhance a thickness of the spaced relationship of the first and second layers, and wherein the spacer yarns maintain opacity in the heat molded fabric.

16. The fabric of claim 1 heat-molded to form a brassier breast cup.

17. A brassier comprising:

a weft knit breast cup having a first substantially decorative design, weft knit, discrete fabric layer comprising an elastomeric yarn plated with a first yarn, a second, weft knit, discrete fabric layer comprising an elastomeric yarn and having a different construction than the first layer, and a plurality of resilient, multi-filament, textured spacer yarns inlay tucked into at least the first layer and extending between the first and second layers to secure the layers in a spaced relationship and separated from each other, wherein a spacer yarn of the plurality of spacer yarns is tucked into the first layer by a first feed, wherein the elastomeric yarn of the first layer is fed by a subsequent feed with selected knit and tuck stitches, wherein the elastomeric yarn of the first layer is not tucked where the spacer yarn of the first feed is tucked, wherein the breast cup is heat molded, wherein the elastomeric yarns of the first and second layers enhance a thickness of the spaced relationship of the first and second layers, and wherein the spacer yarns maintain opacity in the heat molded breast cup.

18. A multi-layer, weft knit, spacer fabric that is weft knit on a knitting machine having a cylinder and a dial, said fabric comprising:

(A) a first, weft knit, discrete fabric layer comprising (i) an elastomeric yarn, and (ii) at least a second yarn, (iii) wherein said elastomeric yarn is knit by a first Feed around a first set of needles, and (iv) wherein said second yarn is fed by a second Feed to miss on at least one needle knit by said first Feed;

(B) a second, weft knit, discrete fabric layer comprising an elastomeric yarn and having a different construction than the first layer; and (C) a plurality of resilient, multi-filament, textured spacer yarns secured within the knit structure of each of said first and second layers and extending between the layers to secure the layers in a spaced relationship and separated from each other, wherein said spacer yarns are secured using needles of the cylinder and the dial, and wherein the elastomeric yarns of the first and second layers enhance a thickness of the spaced relationship of the first and second layers, and wherein the spacer yarns maintain opacity in the heat molded fabric.

19. The fabric of claim 18, wherein said elastomeric yarn of said first layer is plated with at least one other yarn or is a covered yarn.

20. The fabric of claim 18, wherein said second yarn fed by the second Feed to miss on at least one needle knit by said first Feed is further fed to knit on at least one additional needle knit by said first Feed.

21. The fabric of claim 18, wherein said fabric includes delustered pigment print.

22. A jacquard-faced multi-layer, weft knit, spacer fabric comprising:

a first jacquard design, weft knit, discrete fabric layer comprising an elastomeric yarn;

a second weft knit, discrete fabric layer comprising an elastomeric yarn and having a different construction than the first layer; and a plurality of resilient, multi-filament, textured spacer yarns secured within the knit structure of each of said first and second layers and extending between the layers to secure the layers in a spaced relationship and separated from each other, wherein a spacer yarn of the plurality of spacer yarns is tucked into the first layer by a first Feed, wherein the elastomeric yarn of the first layer is fed by a subsequent feed with jacquard-selected knit and tuck stitches, wherein the jacquard-selected tuck stitches are not tucked where the spacer yarn of the first Feed is tucked, wherein the elastomeric yarns of the first and second layers enhance a thickness of the spaced relationship of the first and second layers, and wherein the spacer yarns maintain opacity in the heat molded fabric.

* * * * *